US009072383B2

(12) United States Patent
Schradin et al.

(10) Patent No.: US 9,072,383 B2
(45) Date of Patent: Jul. 7, 2015

(54) MODULAR CHAIR MECHANISM WITH SELF-WEIGHING

(75) Inventors: Aaron Jon Schradin, Holland, MI (US); Nicolas Edward Emenaker, Hamilton, OH (US); Brett William Kooistra, Grand Haven, MI (US)

(73) Assignee: L&P Property Management Company, South Gate, CA (US)

( * ) Notice: Subject to any disclaimer, the term of this patent is extended or adjusted under 35 U.S.C. 154(b) by 229 days.

(21) Appl. No.: 13/587,889

(22) Filed: Aug. 16, 2012

(65) Prior Publication Data

US 2014/0049082 A1 Feb. 20, 2014

(51) Int. Cl.
*A47C 1/024* (2006.01)
*A47C 1/025* (2006.01)

(52) U.S. Cl.
CPC ..... *A47C 1/0248* (2013.01); *A47C 1/025* (2013.01)

(58) Field of Classification Search
CPC ..... A47C 1/0248; A47C 1/025
USPC ..... 297/302.4, 303.1, 303.4, 303.5
See application file for complete search history.

(56) References Cited

U.S. PATENT DOCUMENTS

| | | | | |
|---|---|---|---|---|
| 2,329,673 | A * | 9/1943 | Wood | 297/303.5 |
| 4,170,382 | A * | 10/1979 | Wheeler | 297/300.5 |
| 4,533,177 | A * | 8/1985 | Latone | 297/303.5 |
| 4,695,093 | A | 9/1987 | Suhr et al. | |
| 4,709,962 | A | 12/1987 | Steinmann | |
| 4,840,426 | A | 6/1989 | Vogtherr | |
| 4,858,993 | A | 8/1989 | Steinman | |
| 5,026,117 | A | 6/1991 | Faiks et al. | |
| 5,038,435 | A * | 8/1991 | Crawford et al. | 7/165 |
| 5,121,968 | A | 6/1992 | Eppler | |
| 2010/0096894 | A1 * | 4/2010 | Fukai | 297/300.5 |

FOREIGN PATENT DOCUMENTS

| | | | |
|---|---|---|---|
| EP | 1353584 | A1 | 10/2003 |
| WO | 02058514 | A1 | 8/2002 |
| WO | 2009127862 | A1 | 10/2009 |

OTHER PUBLICATIONS

PCT Search Report and Written Opinion mailed Jan. 10, 2014; PCT/US2013/055145; 14 pages.

* cited by examiner

*Primary Examiner* — Sarah B McPartlin
(74) *Attorney, Agent, or Firm* — Shook, Hardy & Bacon LLP

(57) ABSTRACT

A modular chair mechanism for limiting travel and adjusting tension in a chair is provided. The chair mechanism generally includes a shuttle that travels inside a housing, with a biasing member that applies tension during travel of the shuttle. An interface is coupled to the shuttle that alters the amount of force required to cause the shuttle to travel. In embodiments, the chair mechanism limits travel of a chair back support assembly to a number of positions based on travel of a shuttle inside the mechanism housing. For example, a feature on an end of the shuttle may selectively abut one of a plurality of retention means on the housing, which determines how far the shuttle may travel in that position. The amount of tension in the biasing member may also be affected by a self-weighing mechanism that applies an initial amount of force against a biasing member.

18 Claims, 19 Drawing Sheets

MODULAR CHAIR MECHANISM WITH SELF-WEIGHING

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

Embodiments of the present invention generally relate to a mechanism for limiting travel and adjusting tension in a chair. More particularly, embodiments of the invention relate to a self-weighing, modular chair mechanism for limiting travel and adjusting tension in a chair.

BACKGROUND OF THE INVENTION

A variety of methods are used to limit travel of and provide tension to an adjustable chair. Traditional travel-limiting and/or tension-adjusting means may be molded into seat-tiling mechanisms or other assemblies incorporated into a chair. Such assemblies are limited in their application and provide little variability with respect to the adjustment and accessibility of a travel-limiting or tension-adjusting means. Additionally, an increasing number of customizable chairs are being developed to tailor a user's seating experience based on the desired "ride" of the chair. However, to facilitate such customization by different users, chair modules with tension adjustment and/or travel limits are typically only designed for use with a single style of chair or a single type of chair assembly.

Accordingly, a need exists for an adjustable chair mechanism that controls both travel limits and tension limits, which addresses the foregoing and other problems.

BRIEF SUMMARY OF THE INVENTION

The present invention generally relates to a modular chair mechanism for limiting travel and adjusting tension in a chair. The chair mechanism generally includes a shuttle that travels inside a housing, with a biasing member that applies tension during travel of the shuttle. An interface is coupled to the shuttle that alters the amount of force required to cause the shuttle to travel inside the housing. In embodiments, the chair mechanism limits travel of a chair back support assembly to a number of positions based on travel of a shuttle inside the mechanism housing. For example, a feature on an end of the shuttle may selectively abut one of a plurality of retention means on the housing, which determines how far the shuttle may travel in that position. Additionally, the amount of tension in the biasing member may also be affected by a self-weighing mechanism that applies an initial amount of force against the biasing member.

One illustrative embodiment of a chair mechanism comprises a modular chair mechanism for use on a chair having a seat support assembly and a back support assembly. The chair mechanism includes a housing positioned along a central longitudinal axis, the housing having first and second ends along the central longitudinal axis, at least a portion of the housing having a rounded exterior surface and having at least one opening on the rounded exterior surface of the housing.

The chair mechanism also includes a shuttle adapted to travel relative to the housing along the central longitudinal axis, the shuttle having first and second ends, at least a portion of the first end of the shuttle exiting the first end of the housing, at least a portion of the second end of the shuttle having at least one retaining feature adapted to selectively abut the at least one opening, wherein travel of the shuttle relative to the housing limits travel of the back support assembly. Further, the chair mechanism includes at least one biasing member for resisting the travel of the shuttle relative to the housing, and an interface coupled to the first end of the shuttle, the interface adapted to selectively adjust a rate of compression of the biasing member during travel of the shuttle inside the housing. Finally, the illustrative embodiment includes a self-weighing assembly coupled to the biasing member, the self-weighing assembly adapted to apply an initial amount of force against the biasing member.

In another illustrative aspect, a modular chair mechanism comprises a housing having a central longitudinal axis, the housing having first and second ends along the central longitudinal axis, at least a portion of the housing having a rounded exterior surface and at least one opening on the rounded exterior surface, wherein the opening comprises a plurality of retaining means at staggered positions relative to the central longitudinal axis. The chair mechanism includes a shuttle adapted to travel relative to the housing along the central longitudinal axis, the shuttle having first and second ends, at least a portion of the first end of the shuttle exiting the first end of the housing, wherein at least one retaining feature coupled to the second end of the shuttle is adapted to selectively abut one or more of the plurality of retaining means on the rounded exterior surface of the housing based on travel of the shuttle relative to the housing. The illustrative chair mechanism also includes at least one biasing member for resisting the travel of the shuttle relative to the housing, and an interface coupled to the first end of the shuttle, the interface adapted to selectively adjust an amount of force required to cause the shuttle to travel relative to the housing along the central longitudinal axis. The chair mechanism further includes a self-weighing assembly coupled to the shuttle, the self-weighing assembly adapted to apply an initial amount of force against the biasing member.

According to a third illustrative aspect, embodiments of a chair mechanism comprise a modular chair mechanism for use on a chair having a seat support assembly and a back support assembly. The chair mechanism comprises a housing positioned along a central longitudinal axis, the housing having first and second ends along the central longitudinal axis, at least a portion of the housing having at least one opening on a curved surface of the housing. The chair mechanism further comprises a shuttle adapted to travel inside the housing along the central longitudinal axis, the shuttle having first and second ends, at least a portion of the first end of the shuttle exiting the first end of housing, wherein at least a portion of the second end of the shuttle is adapted to engage against the at least one opening on the curved surface of the housing, and further wherein travel of the shuttle inside the housing limits travel of the back support assembly. The chair mechanism also includes at least one biasing member for resisting the travel of the shuttle inside the housing, and an interface coupled to the first end of the shuttle, the interface adapted to selectively adjust a rate of compression of the biasing member during travel of the shuttle inside the housing, wherein at least a portion of the interface is coupled to the back support assembly.

Additional objects, advantages, and novel features of the invention will be set forth in part in the description which follows, and in part will become apparent to those skilled in the art upon examination of the following, or may be learned by practice of the invention.

BRIEF DESCRIPTION OF SEVERAL VIEWS OF THE DRAWING

The present invention is described in detail below with reference to the attached drawing figures, wherein.

DETAILED DESCRIPTION OF THE INVENTION

Figure 1:
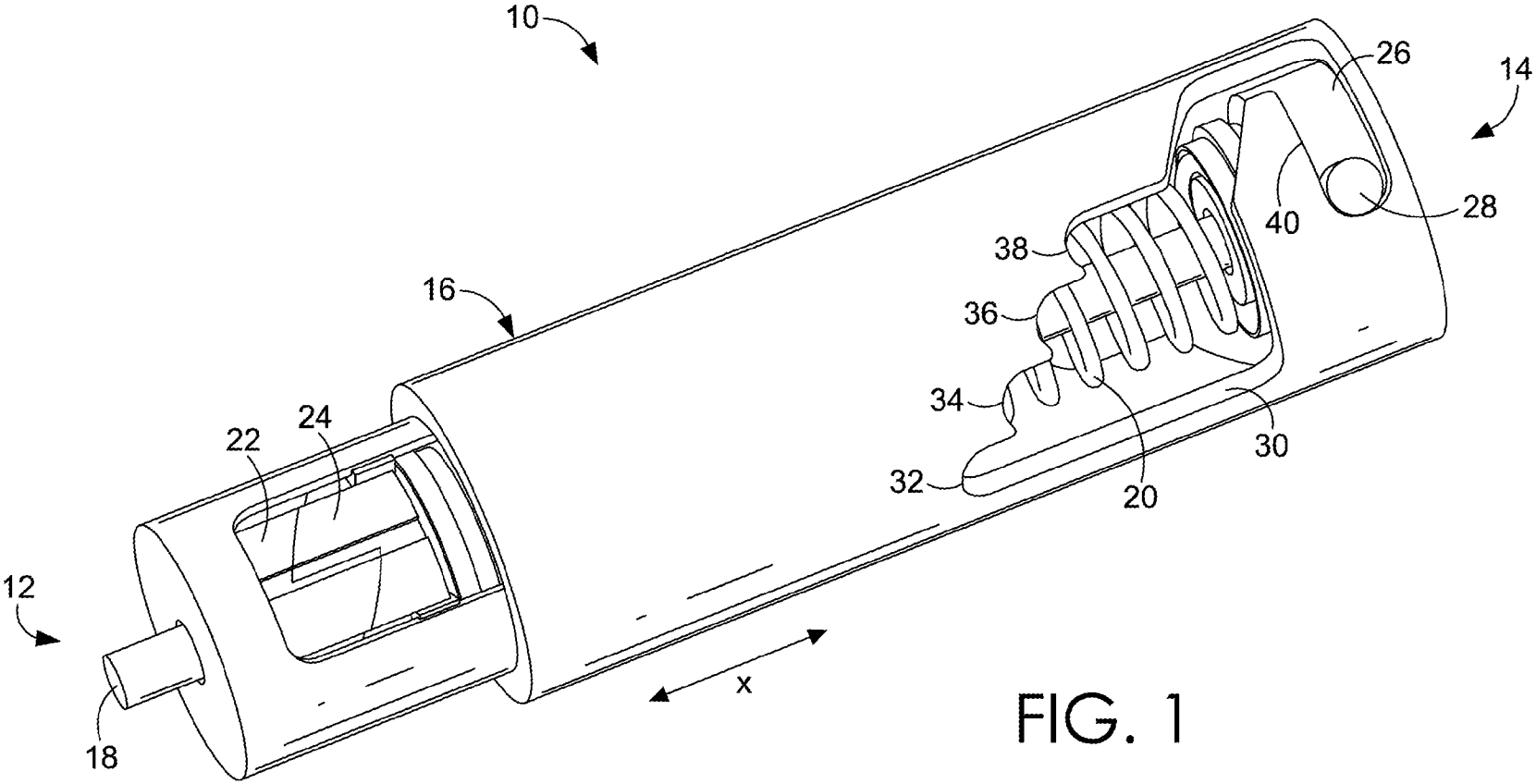
FIG. 1 is a perspective view of the chair mechanism in accordance with an embodiment of the invention.

An embodiment of a modular chair mechanism 10 is seen in FIGS. 1-4. Referring first to FIG. 1, a perspective view of an exemplary chair mechanism 10 is positioned along a central longitudinal axis "x," with axially opposed first and second ends. In one embodiment, the proximal first end 12 is used to adjust the tension-adjusting features of the chair mechanism 10, while the distal second end 14 is used to adjust the travel-limiting features of the chair mechanism 10.

In the embodiment of FIG. 1, the chair mechanism 10 generally includes a housing 16, a shuttle 18, a biasing member 20, a self-weighing mechanism including first and second cams 22 and 24, a cap 26, and a retaining feature 28. As will be discussed in greater detail below, a variety of self-weighing mechanisms may be coupled to the chair mechanism 10 in lieu of or in addition to first and second cams 22 and 24. Accordingly, different means for applying additional force to the biasing member 20 may be added or removed from the chair mechanism 10. Biasing member 20 is disposed inside the housing 16 and around the shuttle 18, which exits from the proximal first end 12 of the housing 16. Further, the biasing member 20 is compressed between the second cam 24 of the self-weighing mechanism and the cap 26. In embodiments, the biasing member 20 is compressed between a second cam 24, or other portion of a self-weighing mechanism or supporting surface at the proximal end of the biasing member 20, that translates along the shuttle 18 while compressing the biasing member 20. As such, travel of the shuttle 18 compresses the biasing member 20 along the central longitudinal axis, and the rate of compression of the biasing member 20 determines the rate at which the shuttle 18 travels.

Biasing member 20 may be made of a variety of materials used to apply pressure against and resist travel of a portion of a chair, as incorporated into a chair mechanism 10. For example, biasing member 20 may be elastomeric, an extension/compression spring, a conical spring, a fluid, a leaf, and/or a constant force spring. In embodiments, biasing member 20 is used to resist travel of the shuttle 18 inside the housing 16, with an initial amount of pressure applied to the biasing member via a self-weighing mechanism.

The self-weighing mechanism is slidably disposed over the shuttle 18, adjacent to the proximal first end 12 of the housing 16. As such, the self-weighing mechanism may apply an initial amount of force against the biasing member 20, while permitting travel of the shuttle 18 through the self-weighing mechanism. The cap 26 is rotatably disposed on the distal second end 14 of the shuttle 18, and includes retaining feature 28 that moves inside an opening 30 on the rounded, exterior surface of the housing 16.

Figure 2:
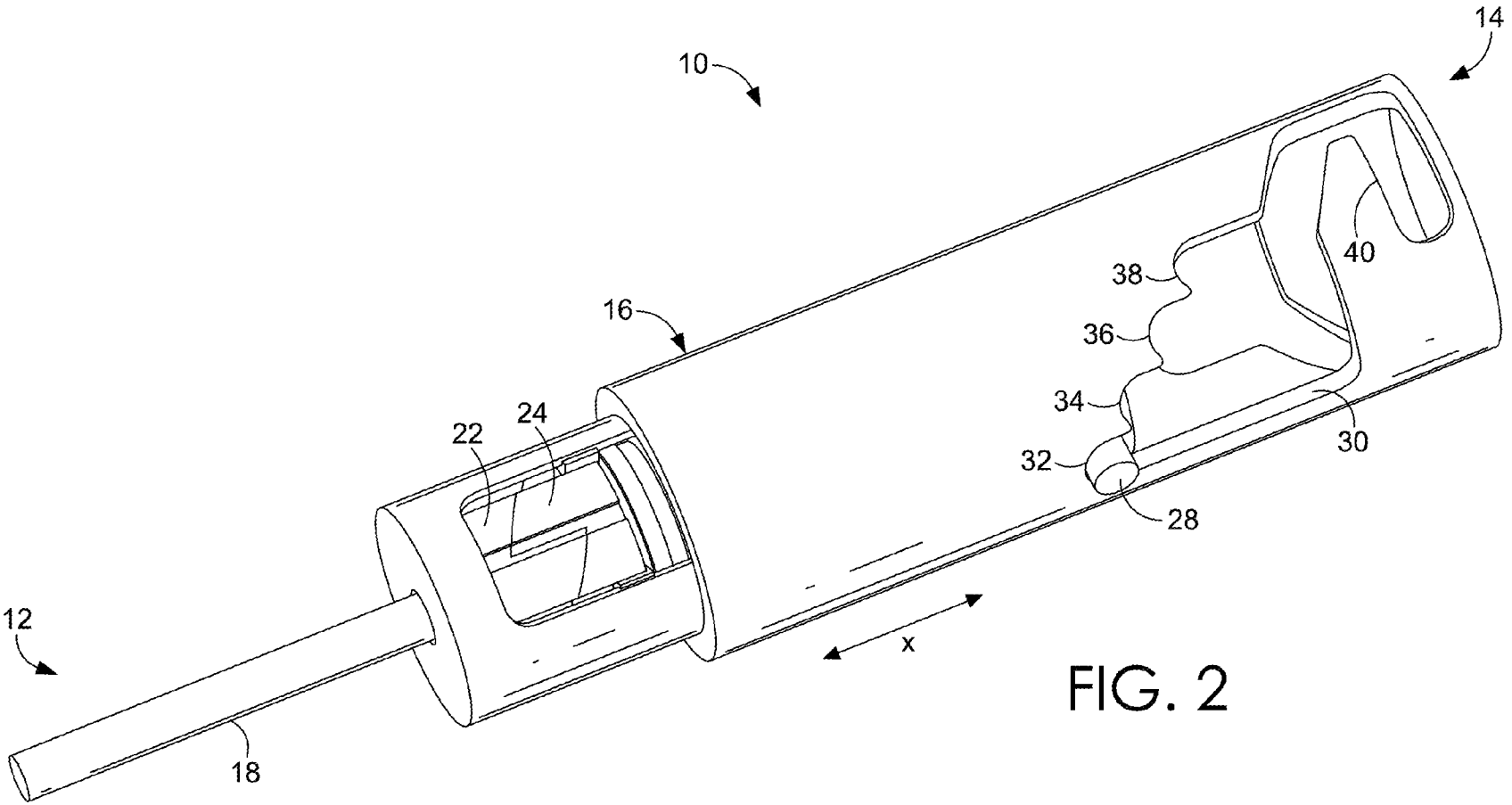
FIG. 2 is a perspective view of the chair mechanism of FIG. 1, with the biasing member in a compressed position based on travel of the shuttle, in accordance with an embodiment of the invention.

The opening 30 includes a series of stair-stepped cutouts that variably limit the travel of the shuttle 18, as attached to the cap 26. As shown in FIG. 1, the opening 30 includes a first retaining means 32, a second retaining means 34, a third retaining means 36, and a fourth retaining means 38. For example, when the retaining feature 28 is engaged against the first retaining means 32, the biasing member 20 may be fully compressed, as shown in FIG. 2. The biasing member 20 may also be compressed against the second, third, or fourth retaining means 34-38, based upon rotation of the cap 26 and abutting of the retaining feature 28 against one of the staggered retaining means.

Figure 3:
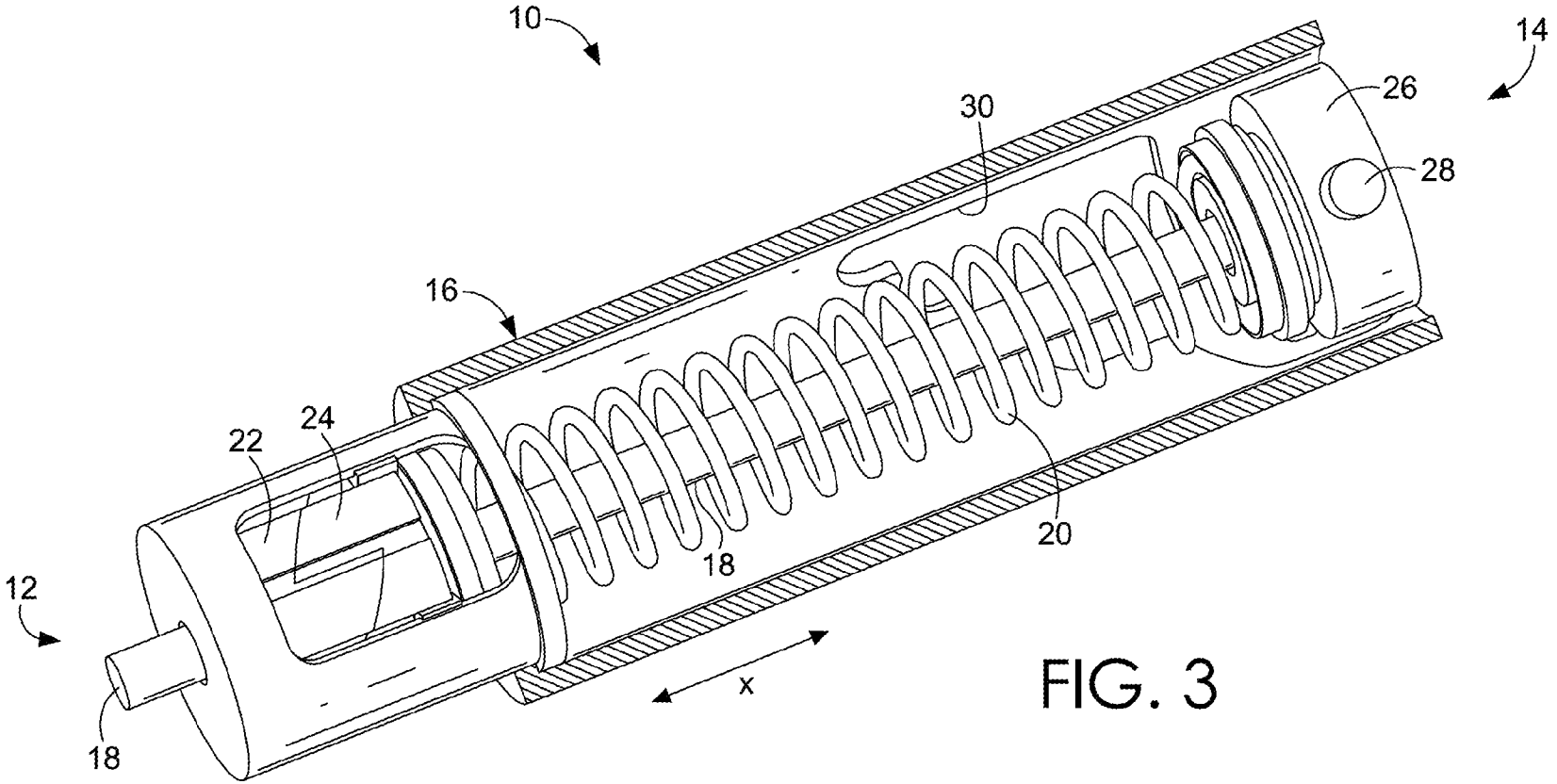
FIG. 3 is a perspective view of the chair mechanism of FIG. 1, with a portion of the housing cut away to reveal the interior of the chair mechanism, in accordance with an embodiment of the invention.

The retaining feature 28 may also be engaged into a forward-locking opening 40 of the opening 30 that prevents travel of the shuttle 18, as coupled to the cap 26. As depicted in FIG. 3, the housing 16 may also include a second opening 30 with repeated stair-stepped retaining means. As such, retaining feature 28 exiting on opposite sides of the housing 16 are translated during travel of the shuttle 18, and adjusted against coordinating sections of the stair-stepped retaining means, or into a resting position in a forward-locking position (such as into the forward-locking opening 40 of FIG. 2). FIG. 3 further illustrates a cut-away portion of the housing 16, revealing the biasing member 20 in an un-compressed position. In other words, the cap 26 is in a neutral position (in forward-locking opening 40) with respect to the biasing member 20, and the self-weighing mechanism (having first and second cams 22 and 24) is not exerting any additional tension against the biasing member 20.

Figure 4:
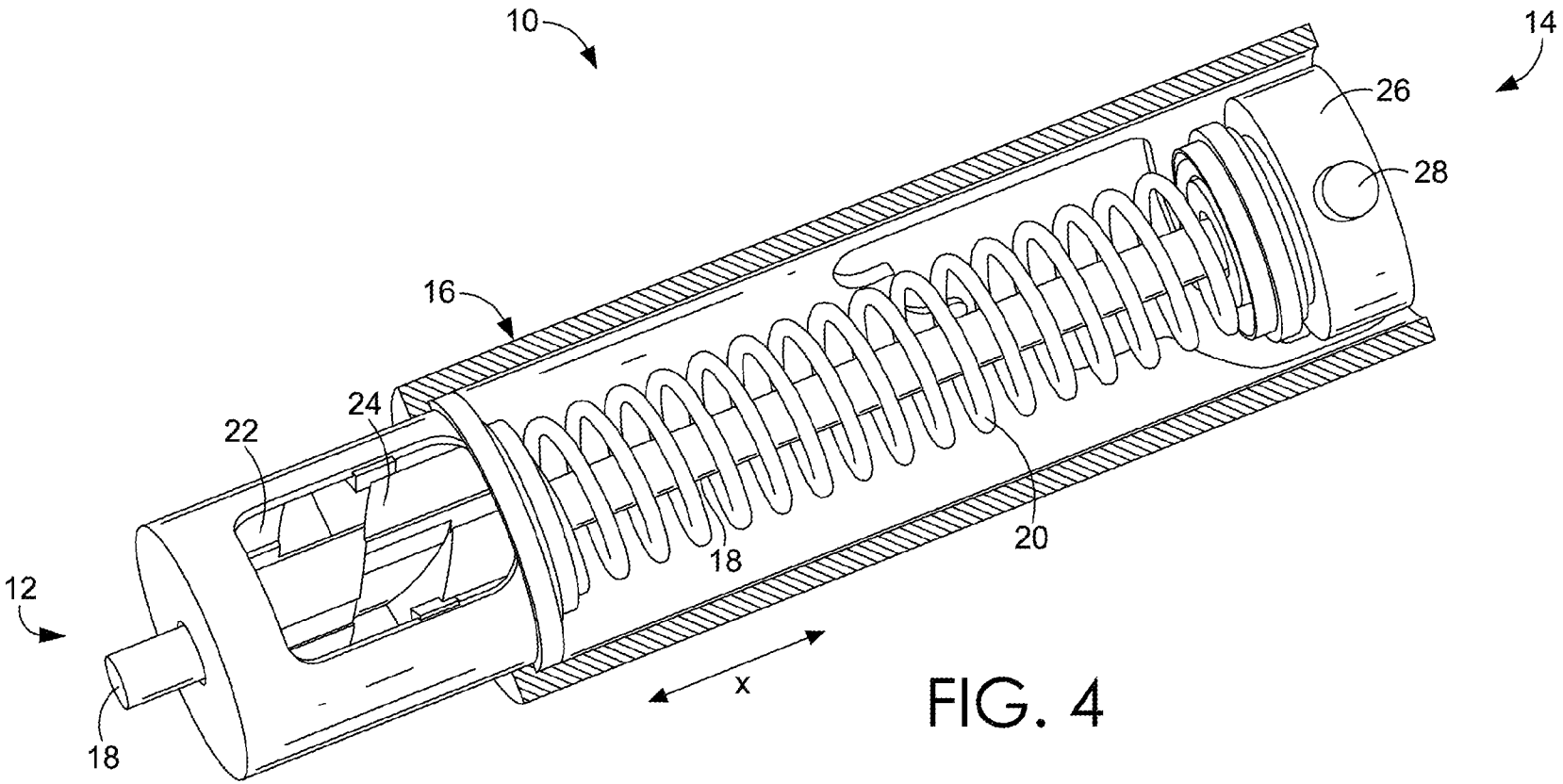
FIG. 4 is a perspective view of the chair mechanism of FIG. 1, with a portion of the housing cut away and an exemplary self-weighing mechanism applying force against the biasing member, in accordance with an embodiment of the invention.

In FIG. 4, rotation of the first cam 22 forces the second cam 24 axially away from the first cam 22 to pre-tension the biasing member 20. As such, the self-weighing mechanism generates a pre-tension of the biasing member 20.

Turning now to FIGS. 5A-5D, various views of exemplary self-weighing mechanisms are shown coupled to a chair mechanism 10. Similar to FIG. 4, the exemplary self-weighing mechanism 42 of FIG. 5A includes opposing cam structures 44 and 46 that rotate against each other to apply pressure in the direction of travel 48 against biasing member 20. As will be understood, cam structure 44 may rotate as well as translate axially in the direction of travel 48 (along the x axis), while cam structure 46 remains stationary with respect to rotation and translates along the x axis while applying force (in the direction of travel 48) against the biasing member 20.

Figure 5B:
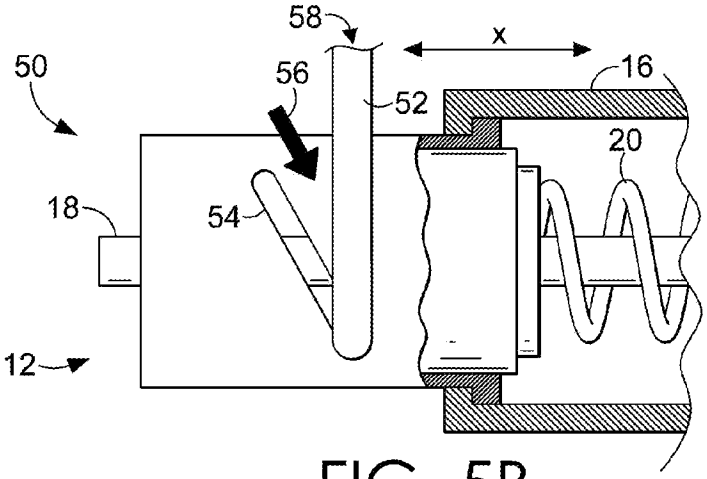
FIGS. 5A-5D are side views of exemplary self-weighing mechanisms coupled to chair mechanisms, in accordance with embodiments of the invention.

In FIG. 5B, self-weighing mechanism 50 includes a link 52 that travels down a path 54 along a direction of travel 56 when pressure is applied to the top end 58 of the link 52. Travel of the link 52 compresses the biasing member 20 along the x axis. For example, pressure may be applied to the top end 58 of the link 52 when an occupant sits on the seat cushion of a chair, which will apply an initial amount of force against the biasing member 20 via the travelling link 52.

Figure 5D:
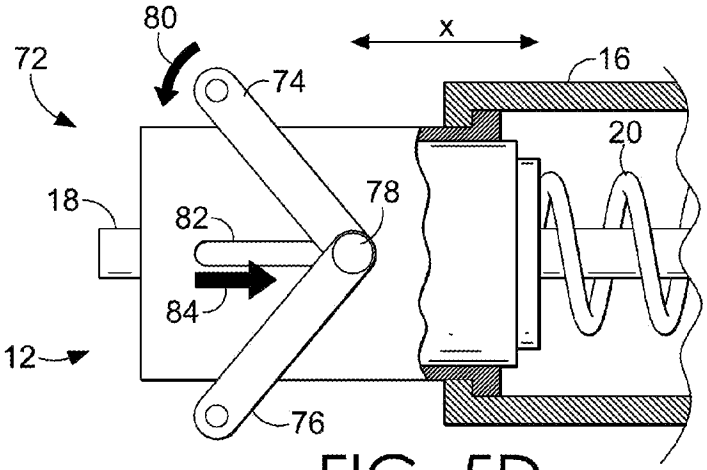
Figure 5A:
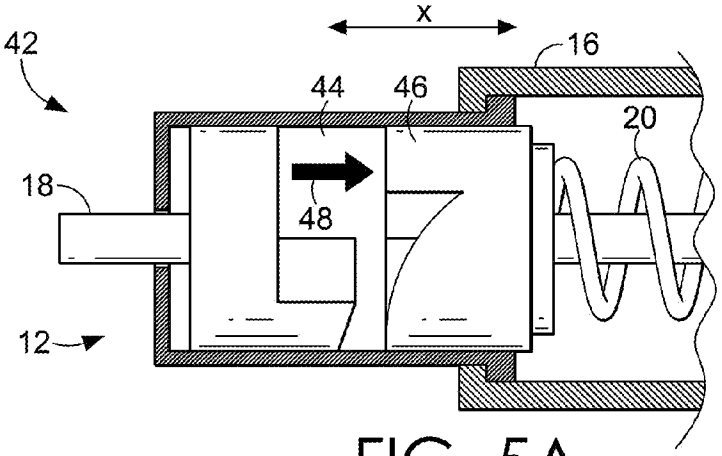
Figure 5C:
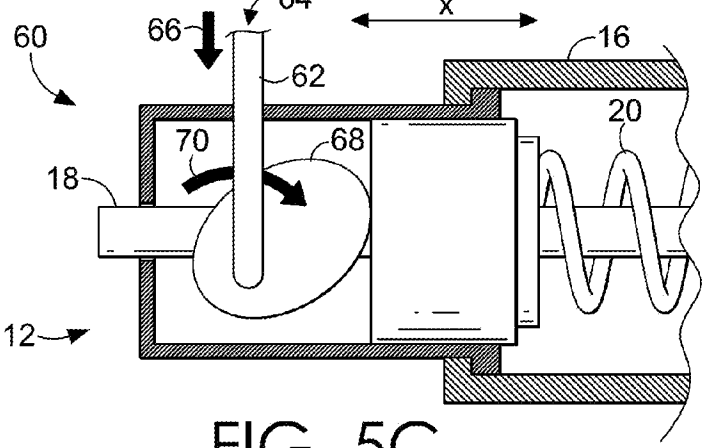

As shown in FIG. 5C, exemplary self-weighing mechanism 60 includes a link 62 that travels when pressure is applied to the top end 64 of the link 62. Travel of the link 62 along the direction of travel 66 causes a cam 68 to pivot in the direction of travel 70 and applies force against the biasing member 20. For example, pressure may be applied to the top end 64 of the link 62 when an occupant sits on a seat cushion, thereby providing an initial amount of force against biasing member 20, and compressing biasing member 20 along the x axis.

In FIG. 5D, self-weighing mechanism 72 includes a pair of links that are coupled together to provide an initial amount of tension against the biasing member 20. In particular, first link 74 is coupled to second link 76 at link joint 78. Second link 76 is stationary, while first link 74 travels in the direction of travel 80, thereby moving the first link 74 closer to the second link 76. Additionally, compression of the first link 74 toward the second link 76 causes travel of the link joint 78 along a path 82 in the direction of travel 84, against biasing member 20. Accordingly, compression of first and second links 74 and 76 causes the link joint 78 to travel along the direction of travel 84 and "pre-tension" the biasing member 20.

Figure 6:
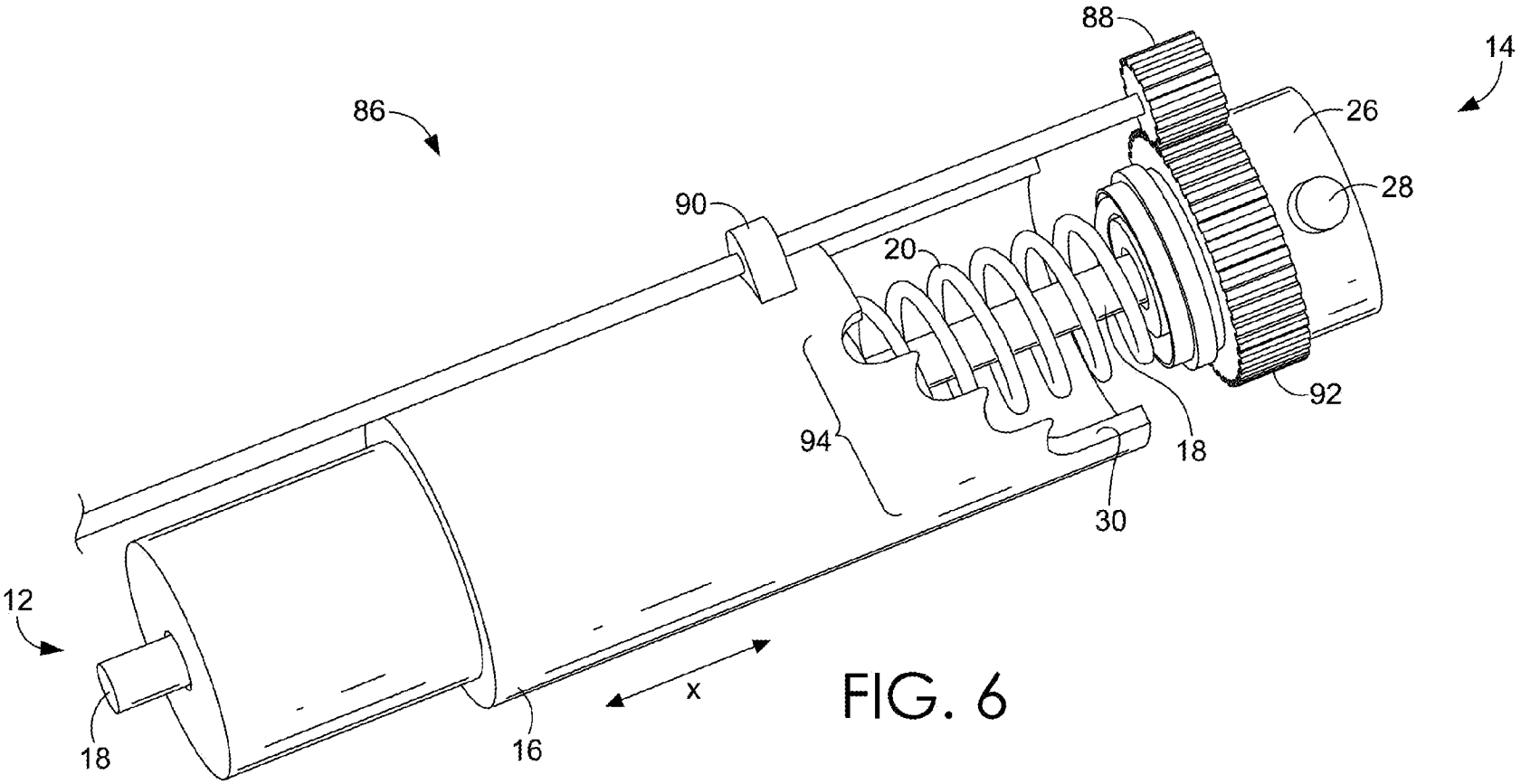
FIG. 6 is a perspective view of a chair mechanism having a gear mounted to the housing that rotates the shuttle inside the housing, in accordance with an embodiment of the invention.

With reference now to FIG. 6, an exemplary chair mechanism 86 includes a gear 88 mounted to the housing 16 at a mounting point 90. The gear 88 rotates the shuttle 18 inside the housing 16 by coupling to the gear 92 on the cap 26. Accordingly, rotation of the gear 88, and corresponding rotation of gear 92, causes rotation of the shuttle 18 relative to the housing 16, and positions the retaining feature 28 to selectively abut one of the multiple retaining means 94 on the opening 30. Further, as incorporated into a chair, the chair mechanism 86 may be used to control the recline limit of a chair back, where the amount of travel of the chair back is determined by which of the retaining means 94 the retaining feature 28 abuts. In some embodiments, the housing 16 of the chair mechanism 86 may remain stationary, while adjustment of the travel limit may involve movement of the shuttle 18 relative to the stationary housing 16.

Figure 7:
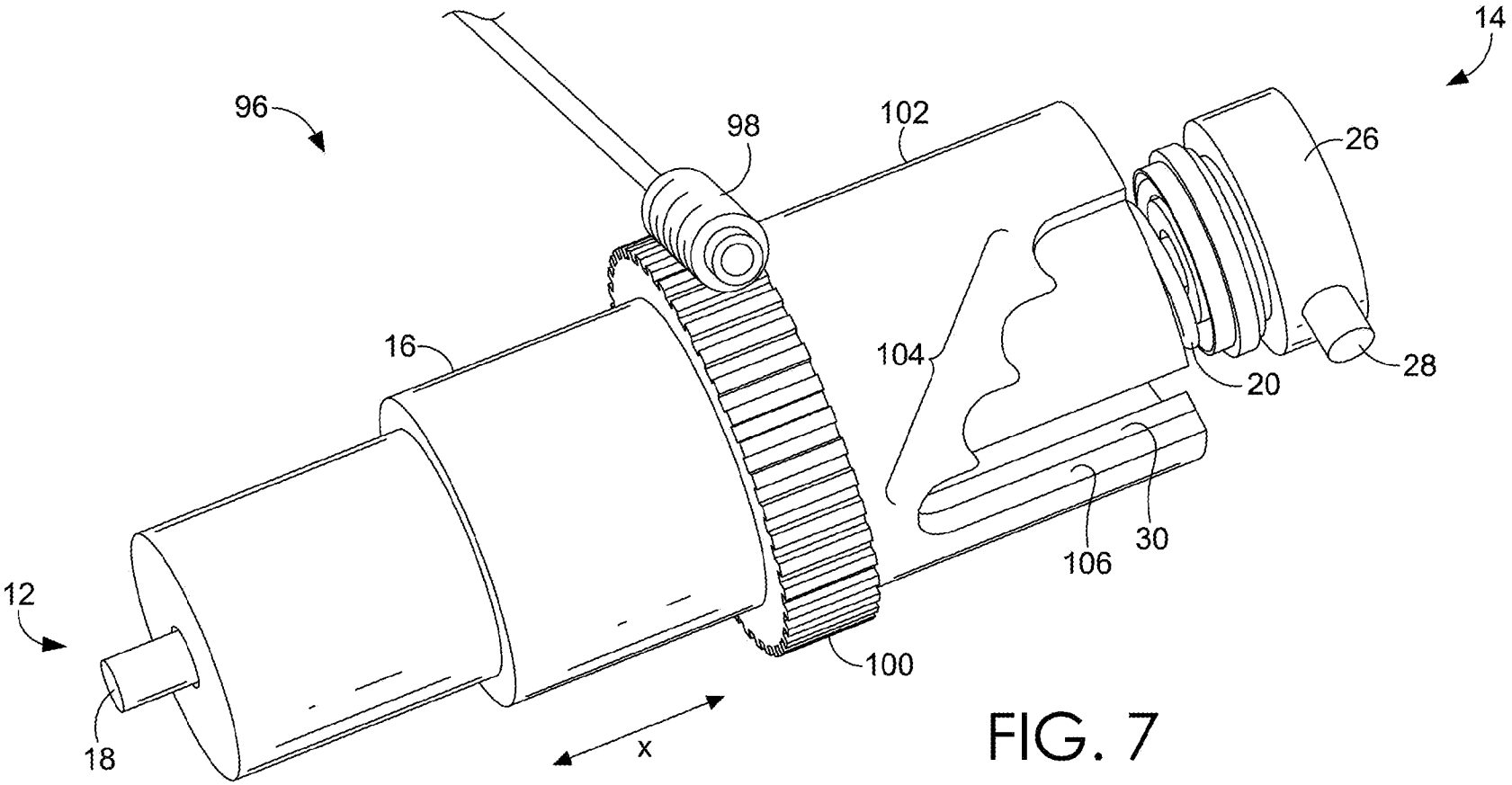
FIG. 7 is a perspective view of a chair mechanism having a gear that rotates the housing around the shuttle, in accordance with an embodiment of the invention.

Turning next to FIG. 7, chair mechanism 96 includes a gear 98 that couples to a gear 100 on a collar 102 on the outside of the housing 16. The collar 102 has a plurality of retaining means 104 on an opening 106, in staggered positions relative to the x axis. Rotation of the gear 98 rotates the collar 102 relative to the housing 16, which allows the retaining feature 28 to selectively abut one of the plurality of retaining means 104 during travel of the shuttle 18 relative to the housing 16. Accordingly, the chair mechanism 96 may be used to control the recline limit of a chair back, where the amount of travel of the chair back is determined by which of the retaining means 104 the retaining feature 28 abuts. In some embodiments, the shuttle 18 of the chair mechanism 96 may remain stationary, while adjustment of the travel limit involves movement of the collar 102 on the outside of the housing 16.

As discussed with respect to FIG. 1, the retaining feature 28 may also be engaged into a forward-locking opening 40 of the opening 30 that prevents travel of the shuttle 18 relative to the housing 16. Accordingly, in FIG. 6, the rotation of gear 88 may be used to position the retaining feature 28 into forward-locking opening 40. Similarly, in FIG. 7, the rotation of gear 98 may be used to position the retaining feature 28 into forward-locking opening 40.

Figure 8C:
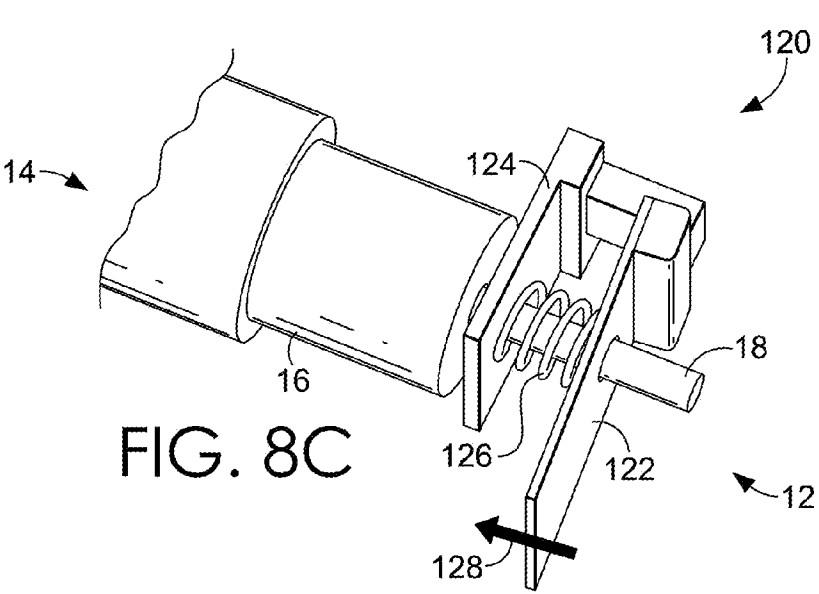
FIGS. 8A-8D are various views of exemplary travel lock mechanisms coupled to chair mechanisms, in accordance with an embodiment of the invention.
Figure 8D:
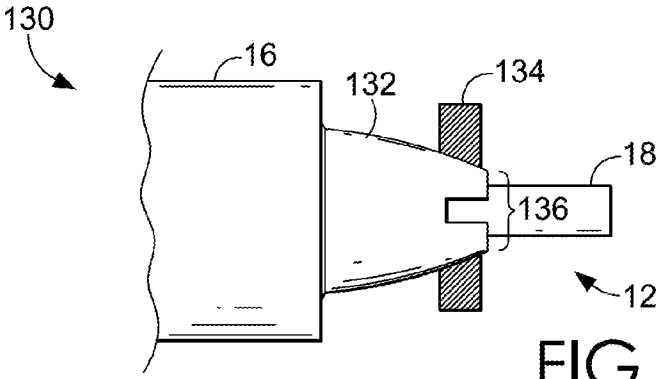
Figure 8A:
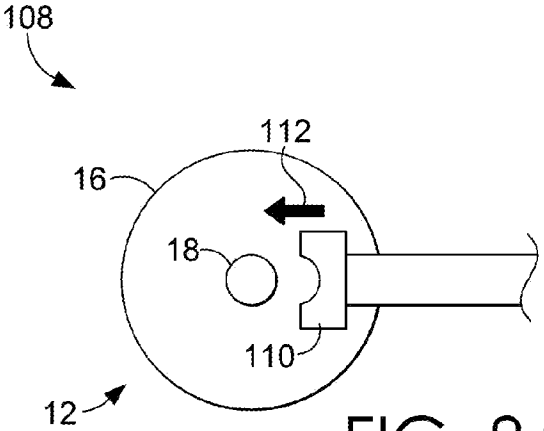

Referring next to FIGS. 8A-8D, embodiments of travel lock methods for preventing and/or resisting movement of the shuttle 18 are described, which include direct or indirect coupling to the shuttle 18 and/or a link coupled to the shuttle 18. In FIG. 8A, a top view of the first end 12 of the chair mechanism 108 depicts a feature 110 that compresses on the shuttle 18 (and/or a link coupled to the shuttle 18) that exits the housing 16. In embodiments, the feature 110 selectively compresses the shuttle 18 and/or link coupled to shuttle 18 based on the positioning of the feature 110 against the shuttle 18 and/or link. Accordingly, the exemplary feature 110 of FIG. 8A may be moved along the direction of travel 112 to directly abut the shuttle 18, and therefore prevent movement of the shuttle 18 relative to the housing 16. In embodiments, the feature 110 includes grooves or other features on the surface of the feature 110 that contacts the shuttle 18 and/or link, which assists creating traction for preventing movement.

Figure 8B:
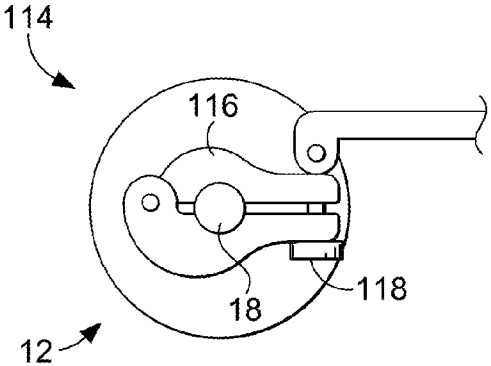

FIG. 8B is a top view of the first end 12 of the chair mechanism 114 that includes a feature 116 that clamps on the shuttle 18 (and/or link coupled to the shuttle 18) that exits the housing 16. The feature 116 includes a clamp adjustment 118 that adjusts the amount of pressure applied to the shuttle 18 and/or link, to prevent and/or restrict travel of the shuttle 18. Additionally, in some embodiments, the feature 116 includes grooves or other features on the surface of the feature 116 that contact the shuttle 18 and/or link, to assist in preventing movement of the shuttle 18.

Turning next to FIG. 8C, the chair mechanism 120 includes a device for preventing travel of the shuttle 18 relative to the housing 16, with a top lock bar 122, a bottom lock bar 124, and a locking spring 126. In embodiments, when top lock bar 122 is pulled back, it releases the chair mechanism 120, allowing the shuttle 18 to travel freely. The spring 126 biases the top lock bar 122 forwardly to a locked position. When bar 122 is not perpendicular to shuttle 18, the hole in bar 122 provides a friction lock to shuttle 18.

FIG. 8D includes a chair mechanism 130 with a collet 132 positioned near the first end 12 of the chair mechanism 130, with the shuttle 18 exiting through the collet 132. A nut 134, when threaded onto the collet 132, compresses the opening 136 of the collet 132 around the shuttle 18, thereby preventing travel of the shuttle 18 relative to the housing 16. Similarly, compression of the opening 136 of the collet 132 may also compress a link coupled to the shuttle 18, thereby preventing travel of the shuttle 18.

Figure 9A:
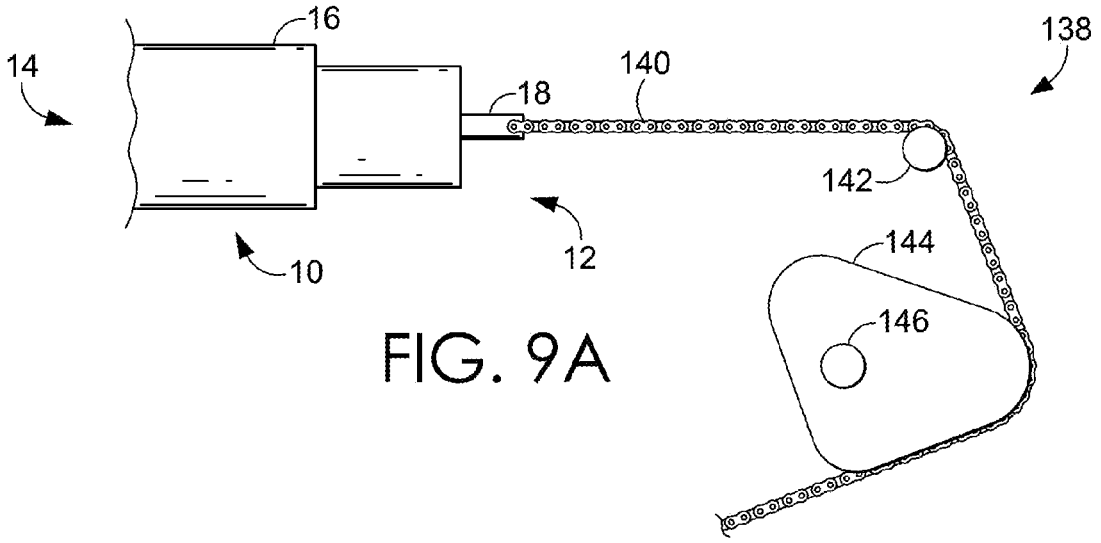
FIGS. 9A-9C are side views of a chair mechanism with a link coupled to the shuttle, the link extended around a fixed cam, in accordance with an embodiment of the invention.

Embodiments of the chair mechanism 10 include a variety of interface options for altering the rate of compression in biasing member 20. For example, FIG. 9A depicts the side view of an exemplary interface 138 with a link 140 coupled to the shuttle 18. The link 140 extends around a fixed cam 142 and a pivoting cam 144 that rotates about a pivot 146. Fixed cam 142 may be coupled to a stationary portion of a chair, such as a seat support assembly. In embodiments, pivoting cam 144 is moved by the structure of the chair, such that the pivoting cam 144 rotates and/or translates with the chair motion to pull the link 140. As the link 140 travels along the surface of pivoting cam 144, pivoting cam 144 alters the rate of compression of the biasing member 20. In embodiments, the biasing member 20 will compress at a different rate inside the housing 16 based on the rotation of the pivoting cam 144 and translation of the link 140. As will be understood, pivoting cam 144 may have, in various embodiments, a differently-shaped profile and/or exterior surface that the link 140 travels against. Accordingly, a different configuration of the profile/exterior surface of pivoting cam 144 may produce a different rate of compression of the biasing member 20, as impacted by the travel of shuttle 18 coupled to link 140. Further, in the example of interface 138, a travel adjustment of the shuttle 18 inside housing 16 does not require the housing 16 of chair mechanism 10 to be rotated.

Figure 9B:
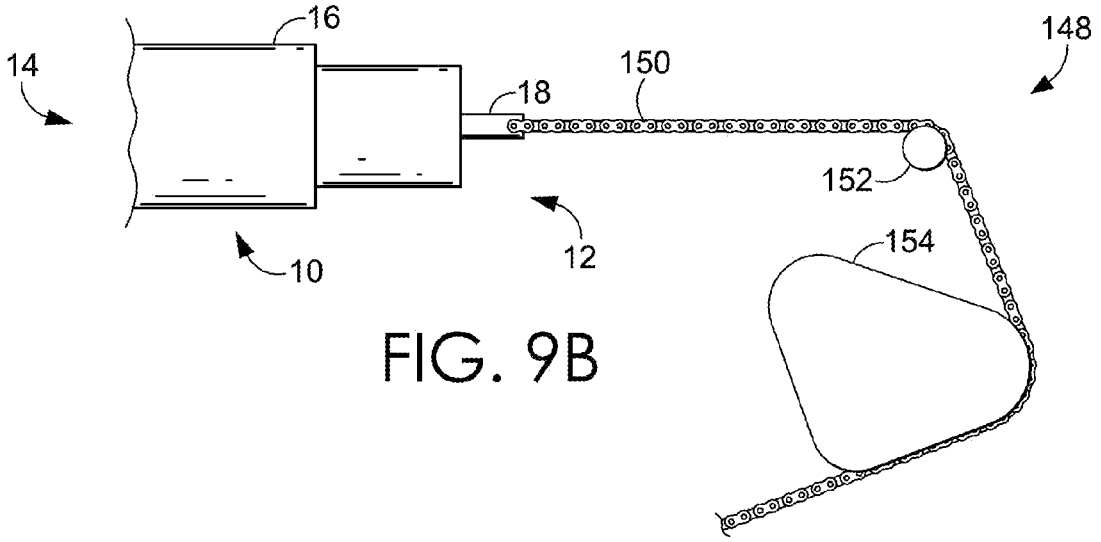

Similar to FIG. 9A, FIG. 9B depicts a side view of an exemplary interface 148 that includes a link 150 coupled to the shuttle 18. The link 150 extends around a fixed cam 152 and a fixed cam 154. However, unlike the pivoting cam 144 of FIG. 9A, fixed cam 154 of FIG. 9B provides a stationary profile/exterior surface against which link 150 travels during compression of biasing member 20, and travel of shuttle 18. In other words, the configuration of the profile/exterior surface of the fixed cam 154 may produce a different rate of compression of the biasing member 20. In the example of FIG. 9B, the location of the chair mechanism 10 may be changed, including the location of the housing 16, to a different location with respect to the fixed cams 152 and 154. Accordingly, adjusting a location of the housing 16 with respect to the fixed cams 152 and 154 alters a rate of compression of the biasing member 20.

Figure 9C:
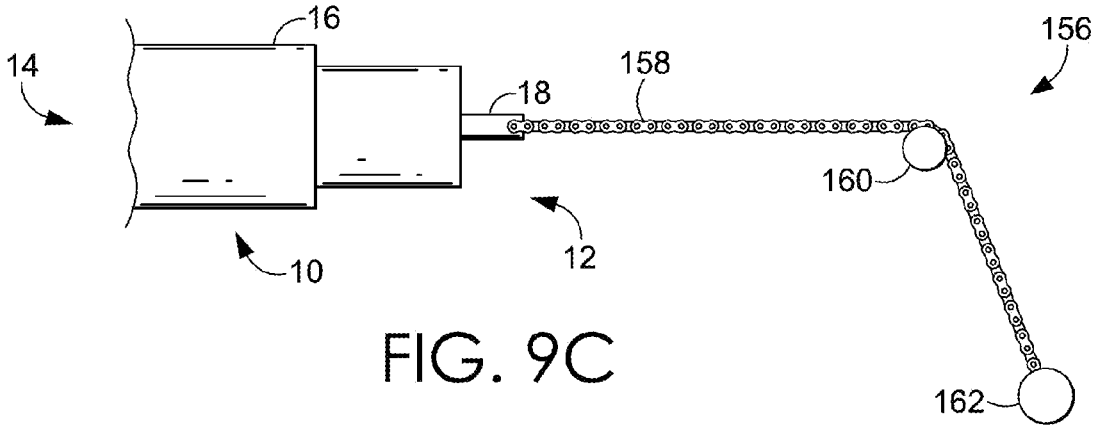

FIG. 9C is a side view of an exemplary interface 156 that includes a link 158 coupled to the shuttle 18. The link 158 extends around a first cam 160 and a second cam 162. Link 158, which exits housing 16 and is coupled to shuttle 18, travels past first cam 160, and link 158 is coupled to second cam 162. Accordingly, the location of housing 16 may be adjusted, resulting in a change in the rate of compression of biasing member 20 based on the position of first cam 160 and/or second cam 162, in relation to the housing 16. Accordingly, because pivoting cam 144 may be rotated in the example of FIG. 9A, the rate of compression of the biasing member 20 may be adjusted without requiring an adjustment of the location of the housing 16 of chair mechanism 10. By contrast, because fixed cams 152 and 154 and first and second cams 160 and 162, remain stationary with respect to the housing 16 of chair mechanism 10, the location of the chair mechanism itself may be adjusted to alter a rate of compression of biasing member 20.

Figure 10A:
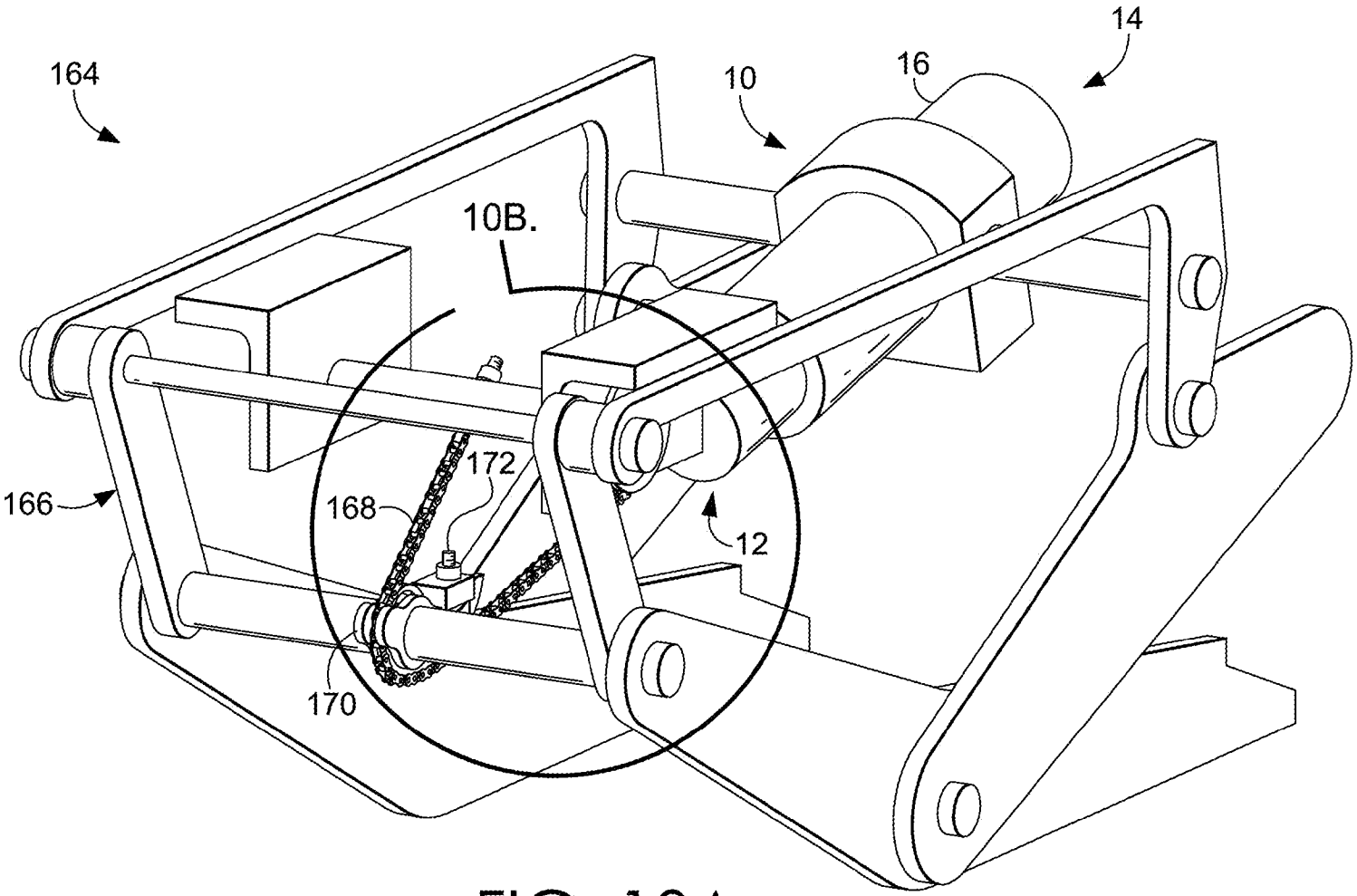
FIG. 10A is a perspective view of a chair mechanism as incorporated into an exemplary seat support assembly, in accordance with an embodiment of the invention.

Turning next to FIG. 10A, an exemplary chair mechanism 10 is coupled to a seat assembly 164. In embodiments, the chair mechanism 10 is coupled to the support structure 166 of the seat assembly 164 for positioning and/or support of the chair mechanism 10. In the example of FIG. 10A, a link 168 (coupled to the shuttle 18 of chair mechanism 10) exits the housing 16 at the proximal first end 12, and wraps around an adjustable cam structure 170. In embodiments, link 168 travels along an exterior surface of the adjustable cam structure 170. In some embodiments, an adjustment point 172 provides for the manual adjustment of the adjustable cam structure 170, and may be coupled directly or indirectly to the adjustable cam structure 170. Accordingly, a link 168 may travel past an adjustable cam structure 170, such that when the adjustable cam structure 170 rotates, the link 168 contacts a different profile of the adjustable cam structure 170 as the adjustable cam structure 170 turns during chair movement. As such, in some embodiments, link 168 travels across a changed profile based on adjustment of the adjustable cam structure 170.

In embodiments, the traveling of link 168 across a changed profile on adjustable cam structure 170 in FIG. 10A is similar to the traveling of link 140 along the surface of pivoting cam 144, as depicted in FIG. 9A. Accordingly, biasing member 20 compresses at a different rate inside the housing 16 based on the profile of adjustable cam structure 170 (FIG. 10A) and/or the profile of pivoting cam 144 (FIG. 9A), and the travel of the corresponding links 140 and 168 based on the change profiles.

Figure 10B:
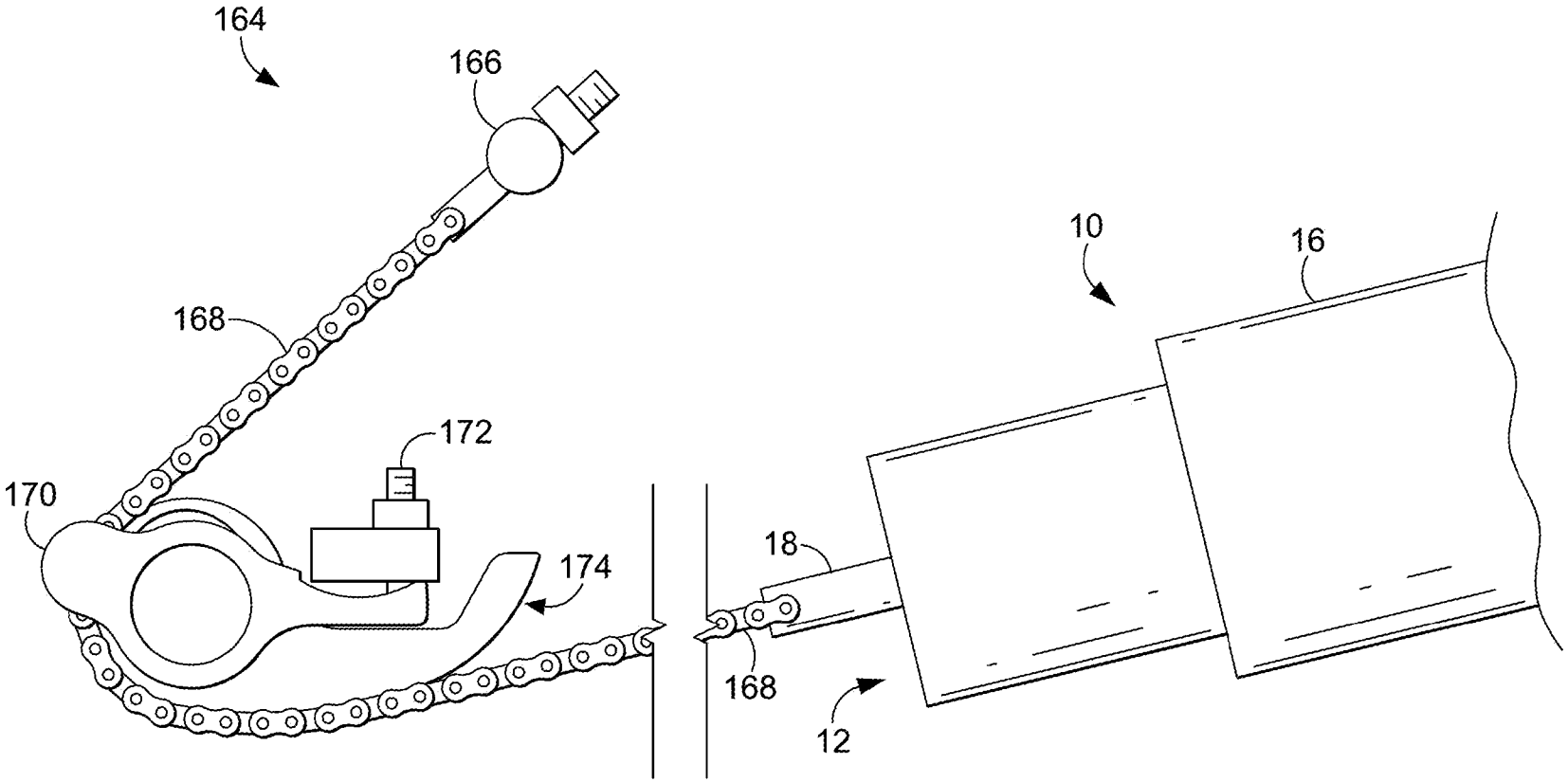
FIG. 10B is an enlarged side view of the chair mechanism of FIG. 10A, as incorporated into an exemplary seat support assembly, in accordance with an embodiment of the invention.

FIG. 10B is an enlarged perspective view of the exemplary chair mechanism 10 of FIG. 10A, as coupled to the seat assembly 164. In one embodiment, link 168 is coupled directly to both the support structure 166 and the shuttle 18 of chair mechanism 10, at opposing ends of link 168. Accordingly, movement and/or travel of the seat assembly 164 and the portion of the support structure 166 coupled to the link 168 causes movement and/or translation of the link 168 (and travel of the shuttle 18, to the extent that travel is limited at the second end 14 of the chair mechanism 10, and by compression applied by biasing member 20). In embodiments, the amount of force required to compress biasing member 20 inside chair mechanism 10 is thereby impacted by the amount of force applied to link 168 from the seat assembly 164, and corresponding movement of support structure 166.

Adjustable cam structure 170 has a cam profile 174 that contacts the link 168 during translation of the link 168. In one embodiment, cam profile 174 may be adjusted using the adjustment feature 172, such as a bolt. Accordingly, adjustment of the shape of cam profile 174 using the adjustment feature 172 alters the rate of compression of biasing member 20, such that the amount of force required to translate link 168 changes based on the particular shape of cam profile 174. For example, an enlarged and/or expanded cam profile 174 creates an overall expanded shape of the adjustable cam structure 170, that the link 168 travels against.

Figure 11:
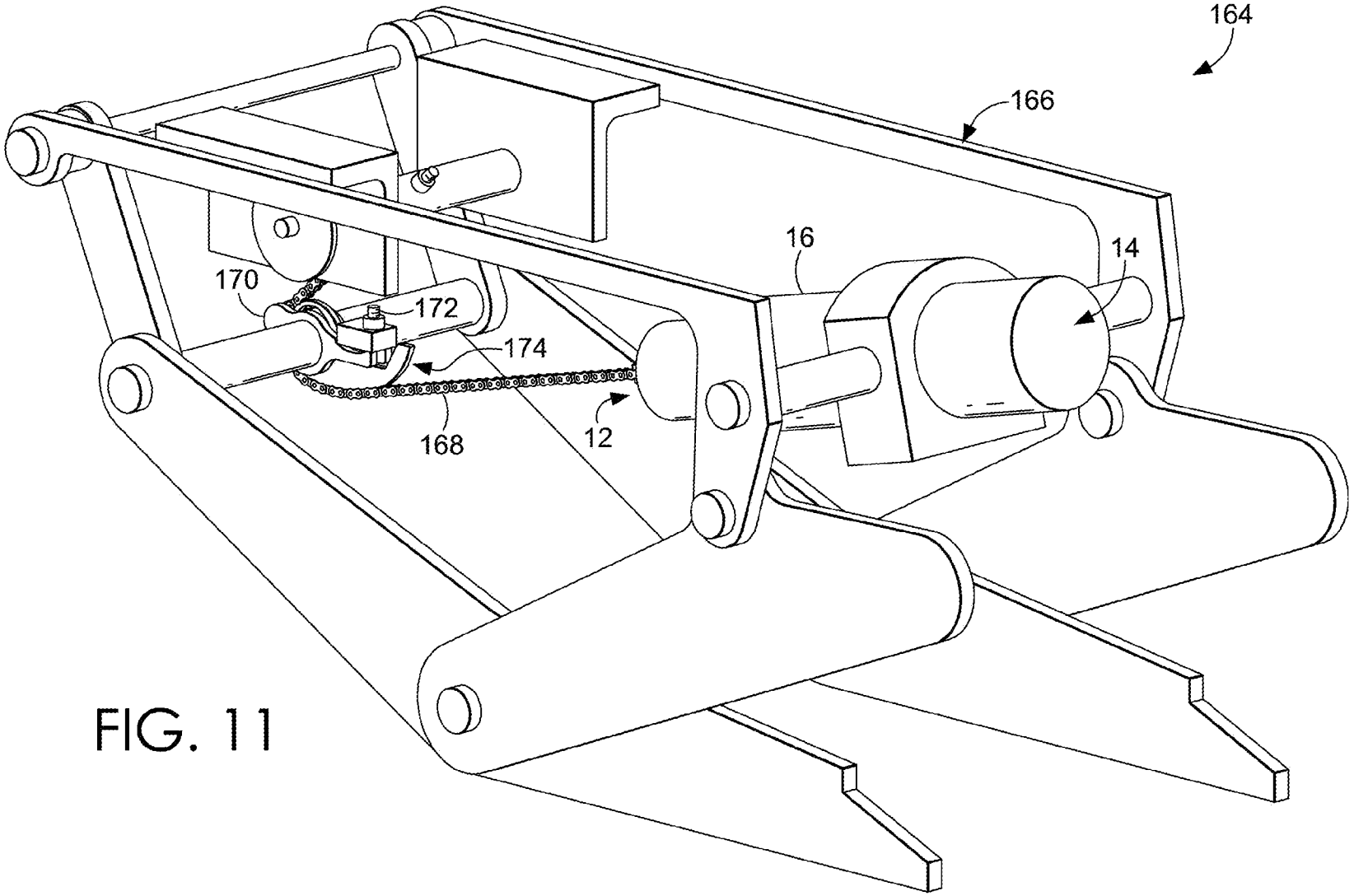
FIG. 11 is a perspective view of a chair mechanism as incorporated into an exemplary seat support assembly, in accordance with an embodiment of the invention.

In FIG. 11, seat assembly 164 is depicted from an alternative perspective view from FIG. 10A. As discussed with reference to FIG. 11, the adjustment of cam profile 174 using adjustment feature 172 changes the shape of adjustable cam structure 170 that contacts link 168. In one embodiment, the translation of at least a portion of seat assembly 164, and corresponding translation of at least a portion of the support structure 166, causes the travel of link 168 across adjustable cam structure 170. In additional embodiments, the amount of force required to translate the seat assembly 164, and the corresponding support structure 166, relates at least in part to the shape of the adjustable cam structure 170, as altered by a change in cam profile 174 using adjustment feature 172.

Figure 12:
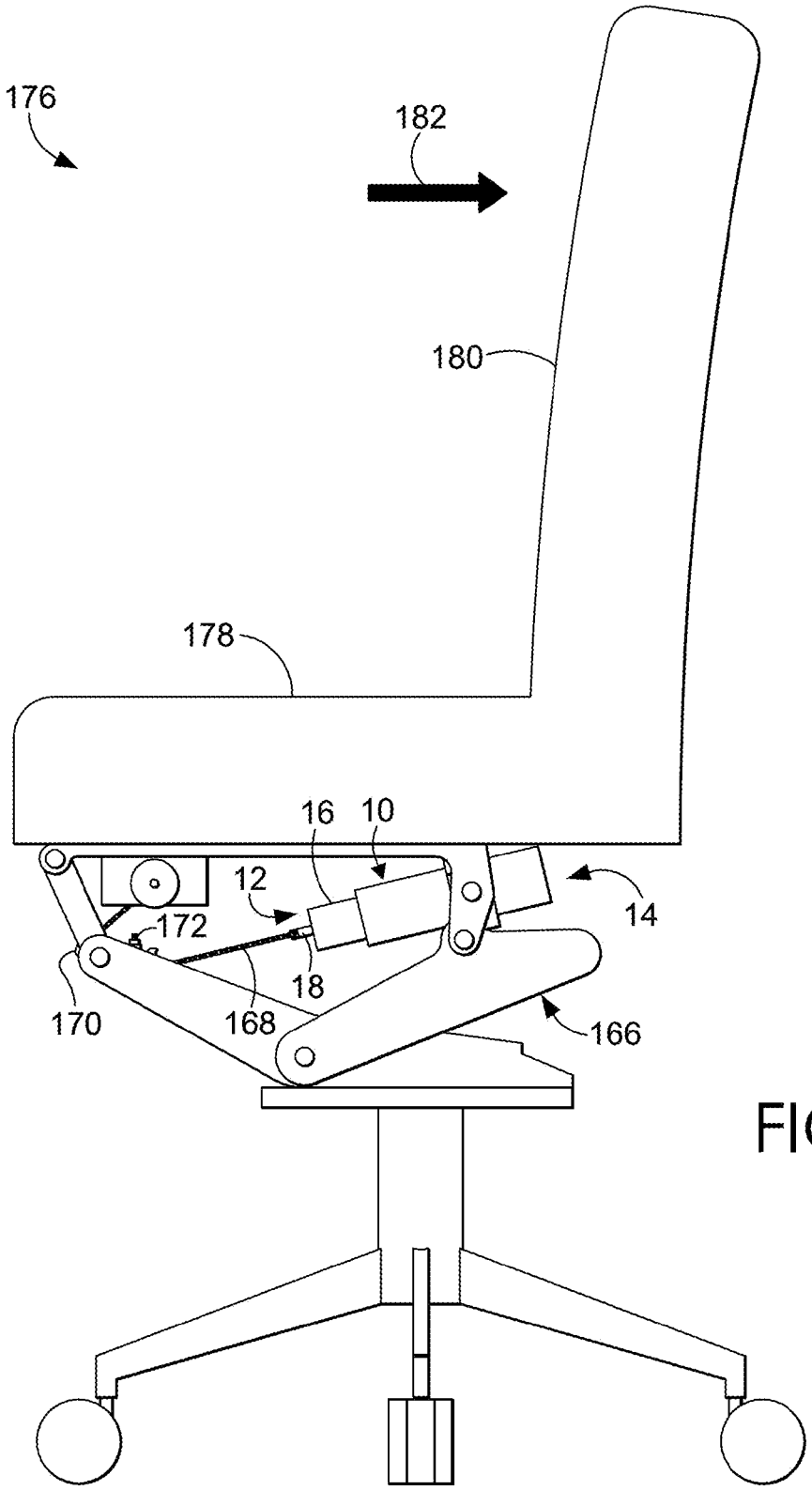
FIG. 12 is a side view of a chair mechanism as incorporated into an exemplary seat support assembly of a chair, in accordance with an embodiment of the invention.

Accordingly, as shown in FIG. 12, an exemplary chair 176 has a seat 178 coupled to a back 180 that travels in a rearward direction 182 based on a user reclining in the chair 176. In embodiments, based on movement of the seat 178 and/or back 180 during recline of the chair 176, link 168 pulls the shuttle 18 from the first end 12 of the chair mechanism 10. Accordingly, a user may adjust the "ride" of the chair 176 using adjustment feature 172 to expand or contract the cam profile 174. In embodiments, adjustable cam structure 170 and chair mechanism 10 are coupled to different portions of the support structure 166 of seat assembly 164. In further embodiments, one or both of the adjustable cam structure 170 and the chair mechanism 10 are coupled to a different portion of a chair 176, such as a different portion of the seat 178 and/or the back 180.

Figure 13A:
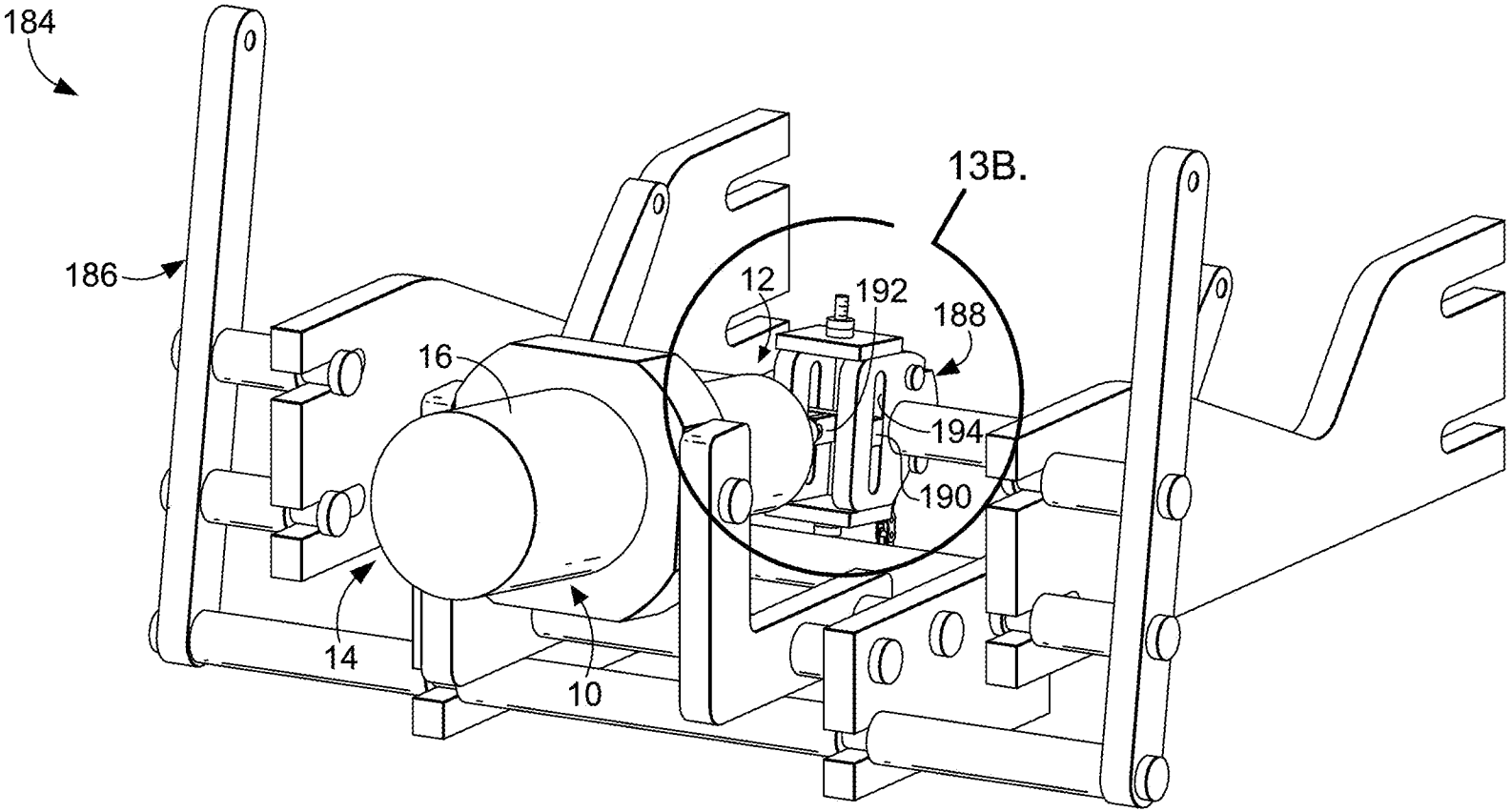
FIG. 13A is a perspective view of a chair mechanism as incorporated into an exemplary seat support assembly, in accordance with an embodiment of the invention.

Turning next to FIG. 13A, an exemplary seat assembly 184 has a support structure 186 with a pivoting body 188 coupled to a chair mechanism 10. In particular, the adjustable mounting point 190 is coupled to the link 192 that exits the first end 12 of housing 16, where link 192 is coupled to the shuttle 18. As viewed in FIG. 13A from the second end 14 perspective of chair mechanism 10, pivoting body 188 is coupled to the first end 12 of chair mechanism 10 using link 192. Accordingly, in some embodiments, pivoting body 188 pivots about at least a portion of support structure 186 during movement of the seat assembly 184 and/or a portion of a chair coupled to support structure 186. Further, the amount of force required for the corresponding portion of the chair to travel depends on the rate of compression of biasing member 20, as impacted by the angle created between pivoting body 188 and chair mechanism 10.

Enlargement 13B more closely depicts the coupling of pivoting body 188 to chair mechanism 10 via link 192 and shuttle 18. In embodiments, adjustable mounting point 190 travels inside opening 194 of pivoting body 188 along the direction of travel "y" with link 192 coupled directly to shuttle 18 and adjustable mounting point 190. Accordingly, adjustable mounting point 190 can be moved above or below the point where pivoting body 188 pivots about a point of attachment to support structure 186. In embodiments, the rate of compression of biasing member 20 may change based on moving adjustable mounting point 190 above or below the pivot of pivoting body 188. As discussed with reference to various embodiments of the chair mechanism, an adjustment of the rate of compression of biasing member 20 may alter the "ride" of a chair coupled to the support structure 186.

Figure 13B:
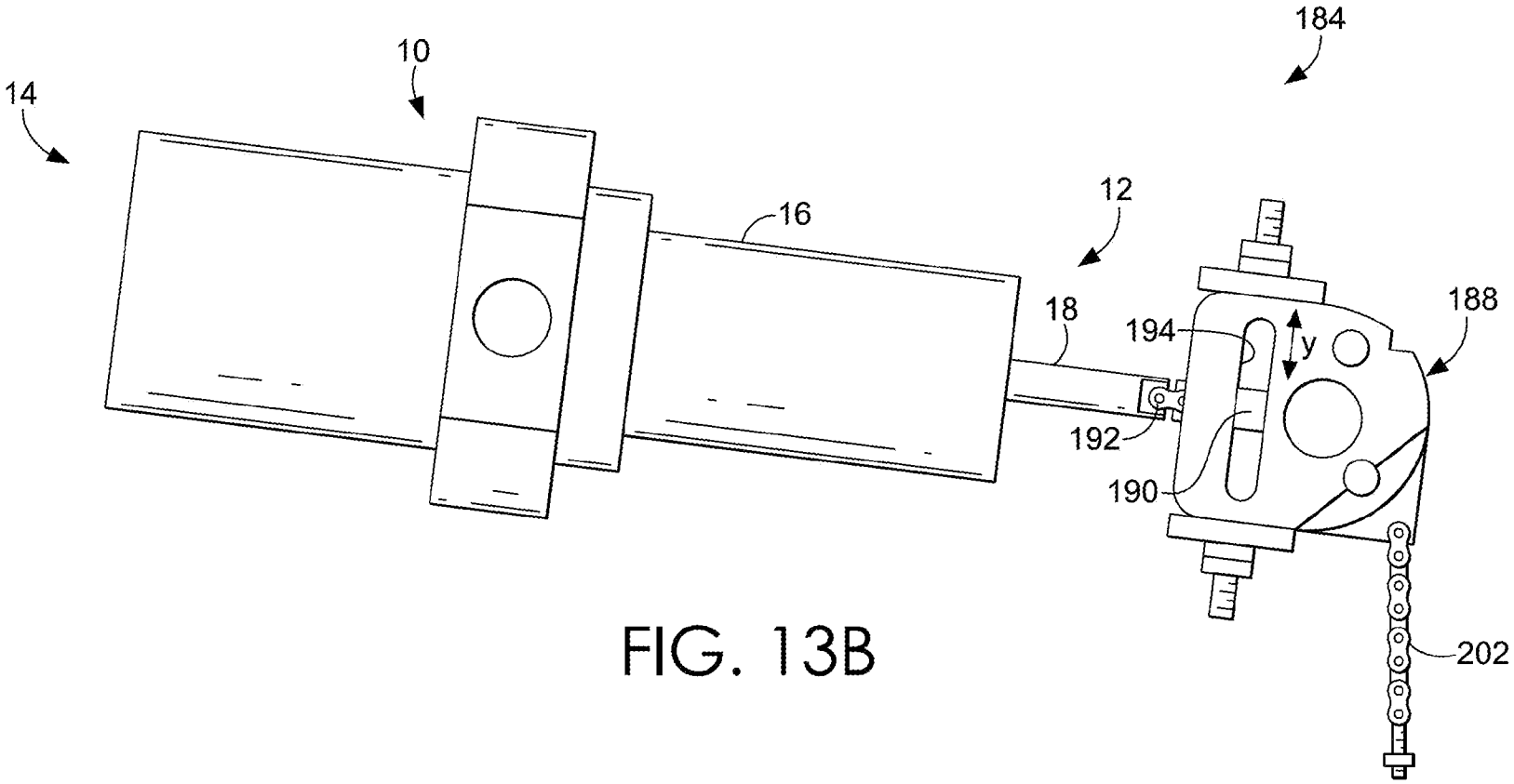
FIG. 13B is an enlarged side view of the chair mechanism of FIG. 13A, as incorporated into an exemplary seat support assembly, in accordance with an embodiment of the invention.

As shown in FIG. 13B, pivoting body 188 may also include a support pin 202 that can be used to restrict rotation of the pivoting body 188. Accordingly, with adjustable mounting point 190 in a particular position inside opening 194, a user may couple support pin 202 to a stationary portion of support structure 186 and/or the chair. In embodiments, a rate of compression of biasing member 20 may be adjusted based on the position of adjustable mounting point 190 within opening 194, and the rotation or restriction of pivoting body 188.

Figure 14:
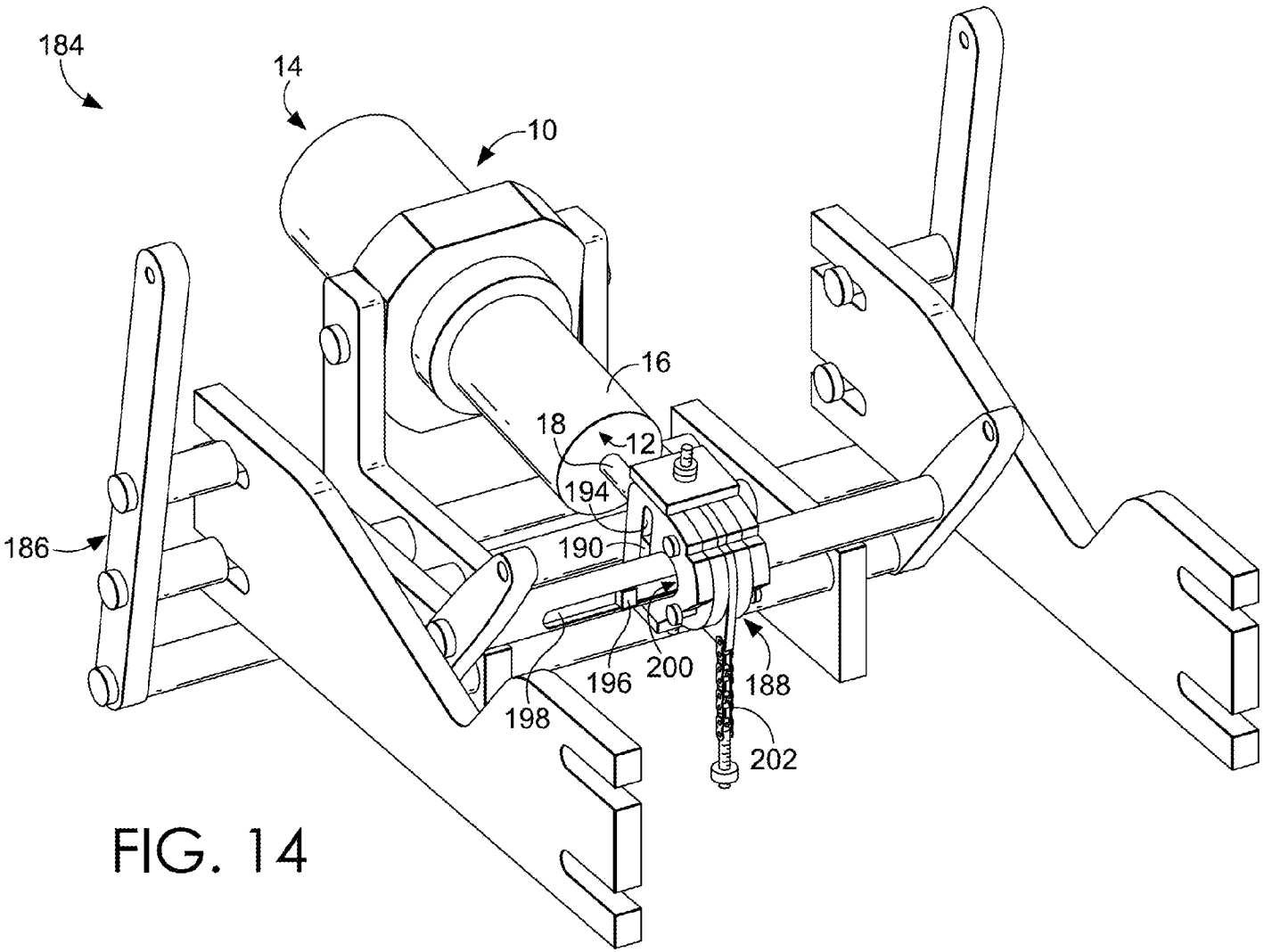
FIG. 14 is a perspective view of a chair mechanism as incorporated into an exemplary seat support assembly, in accordance with an embodiment of the invention.

FIG. 14 depicts an alternative perspective view of exemplary seat assembly 184 with a chair mechanism 10 coupled to support structure 186. In embodiments, a pivot pin 196 travels inside a channel 198 on the portion of the support structure 186 that the pivoting body 188 rotates about. The portion of support structure 186 having the channel 198 fits inside an opening 200 on pivoting body 188. In embodiments, insertion of pivot pin 196 into opening 200 via channel 198 restricts the rotation of pivoting body 188 about the portion of support structure 186. Alternatively, removal of the pivot pin 196 from the opening 200 results in free rotation of the pivoting body 188 around the corresponding portion of the support structure 186.

Figure 15:
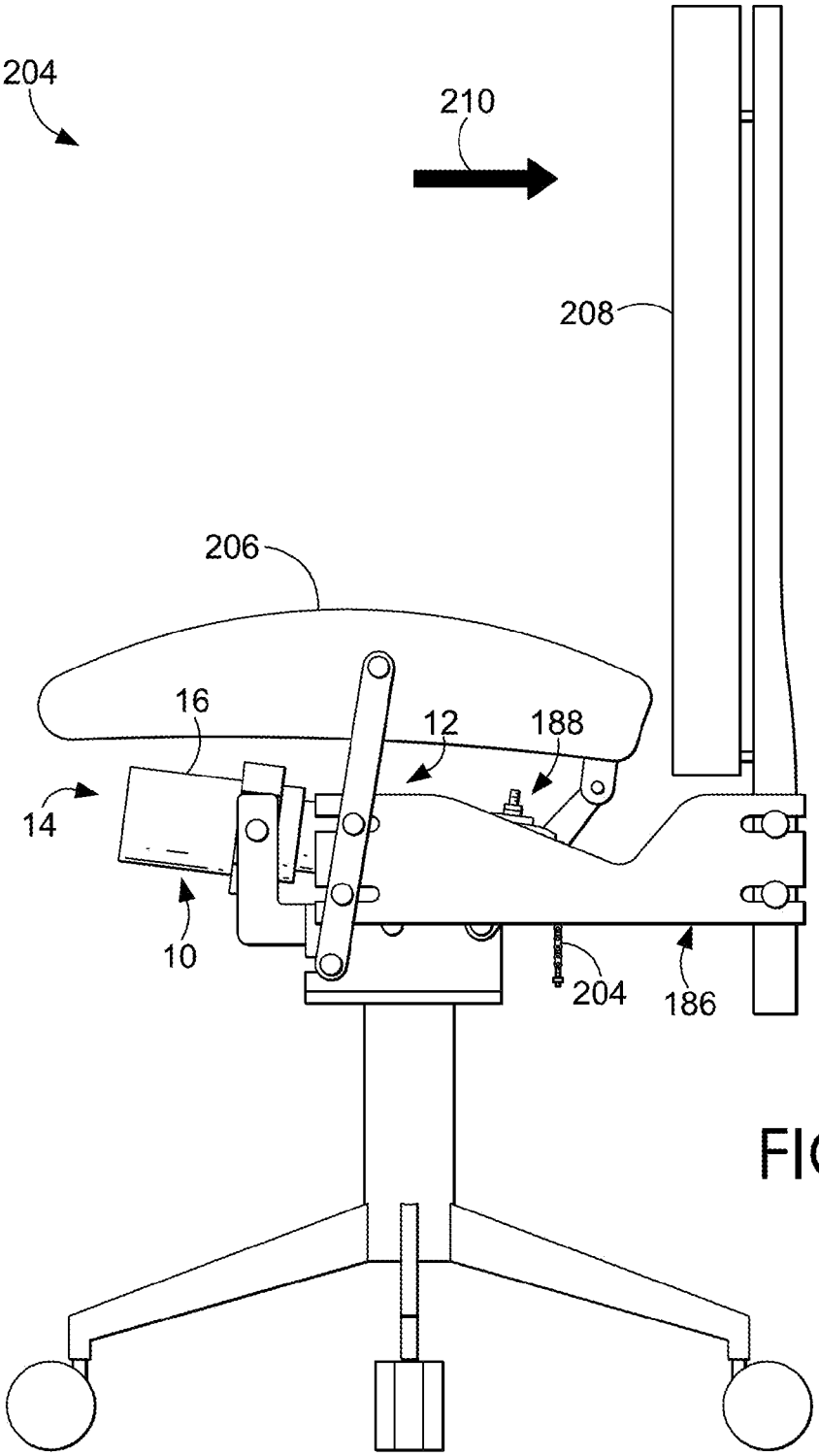
FIG. 15 is a side view of a chair mechanism as incorporated into an exemplary seat support assembly of a chair, in accordance with an embodiment of the invention.

In FIG. 15, an exemplary chair 204 has a seat 206 coupled to a back 208 that reclines when force is applied in a rearward direction 210. In embodiments, based on movement of the seat 206 and/or recline of back 208, link 192 pulls the shuttle 18 from the first end 12 of the chair mechanism 10. Accordingly, a user may adjust the "ride" of the chair 204 using adjustable mounting point 190.

Figure 16:
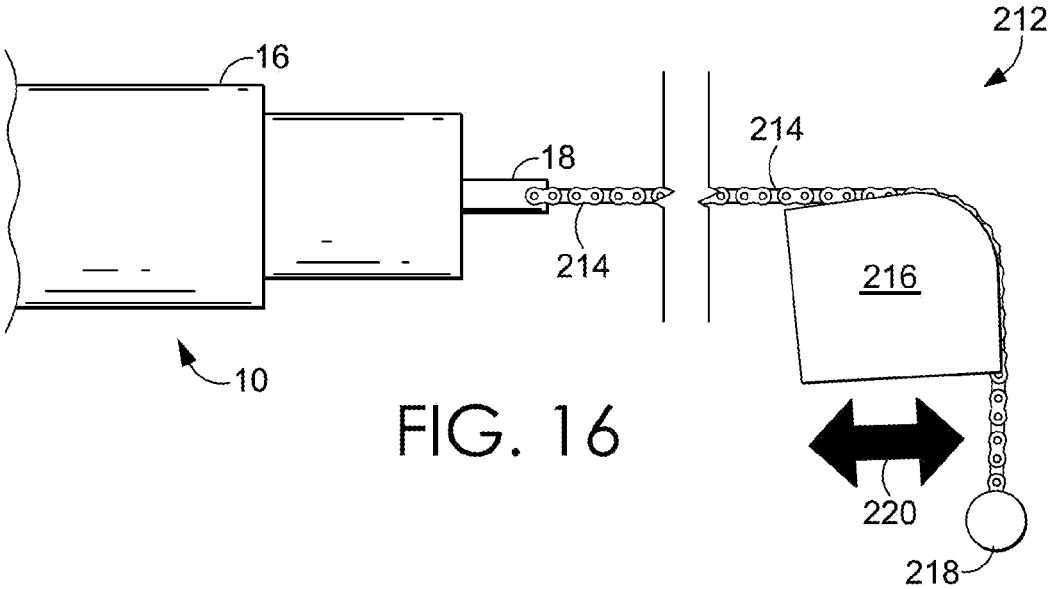
FIG. 16 is a side view of a chair mechanism coupled to a tension-adjustment feature, in accordance with an embodiment of the invention.

Turning next to FIG. 16, an embodiment of a mechanism for adjusting a rate of compression of biasing member 20 includes a link 214 coupled to the shuttle 18 that exits the housing 16 of a chair mechanism 10. In FIG. 16, link 214 is guided along an exterior surface of a first cam 216, and is coupled to a second cam 218. First cam 216 can travel toward or away from the housing 16, causing the amount of pay out of the link 214 to increase or decrease. Accordingly, a rate of compression of biasing member 20 may be altered based on a position of the chair mechanism 10 relative to the first cam 216.

Figure 17:
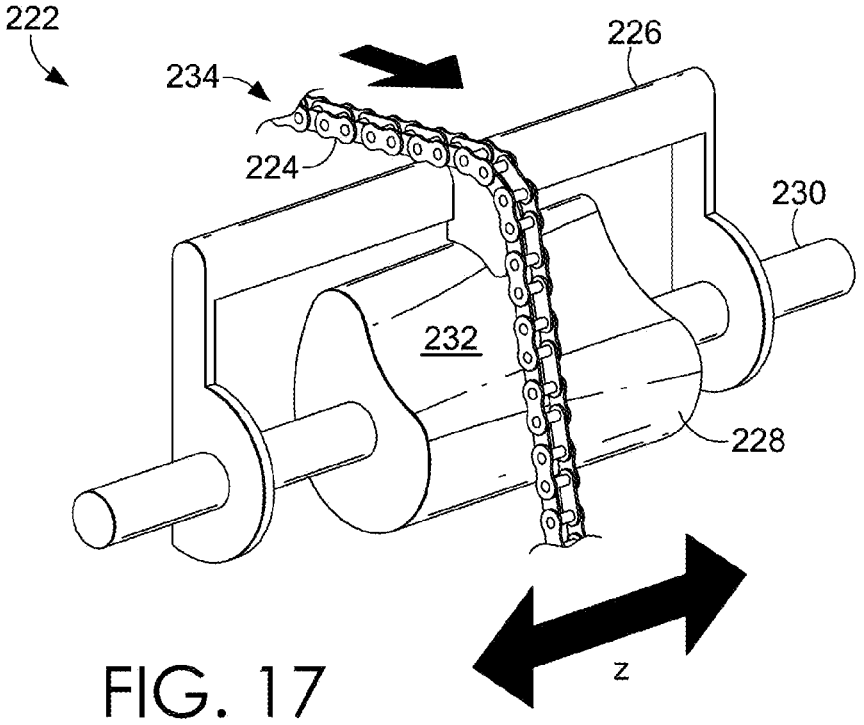
FIG. 17 is a perspective view of a tension-adjustment feature, in accordance with an embodiment of the invention.

FIG. 17 depicts a perspective view of a tension-adjustment feature 222 that guides a link 224 (coming from a housing 16) over a cam follower 226. Cam follower 226 is adapted to abut a portion of cam 228 based on rotation about the rotation axis 230. In embodiments, rotation axis 230 may be a part of a support assembly of a chair. Accordingly, cam follower 226 translates along rotation axis 230 in the direction of travel "z," causing the cam follower 226 to abut a different profile 232 of cam 228. In embodiments, the profile 232 of cam 228 changes along the z direction of travel, such that cam follower 226 guides link 224 over a different size of path based on the portion of the profile 232 that cam follower 226 abuts. As such, the varying size of path over the surface of profile 232 impacts the rate of compression of the biasing member 20 during travel of link 224.

Figure 18A:
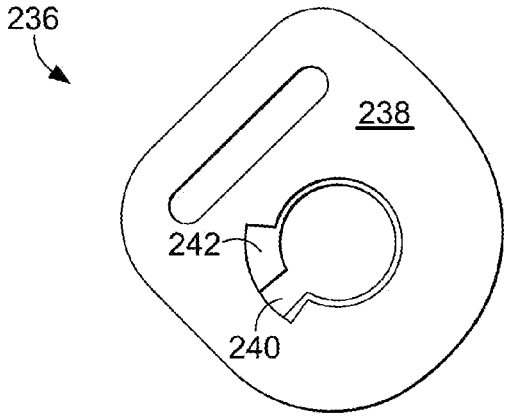
FIGS. 18A-18C are balancing mechanisms, according to embodiments of the invention.
Figure 18B:
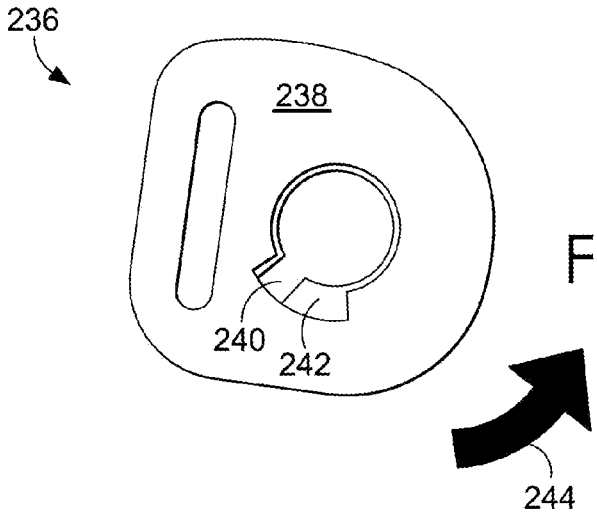

FIGS. 18A-18B depict embodiments of a balancing mechanism 236 for coupling to a chair mechanism 10. In FIG. 18A, balancing mechanism 236 has a cam housing 238 with a pivoting cam 240 inside an internal chamber 242. As can be seen in FIG. 18B, rotation of cam housing 238 in the direction of travel 244 causes the pivoting cam 240 to abut a different portion of internal chamber 242. In embodiments, a range of motion of the balancing mechanism 236 is determined by the amount of space in the internal chamber 242, and the size of the pivoting cam 240. In embodiments, balancing mechanism 236 may be utilized to adjust the amount of force applied against biasing member 20 and/or the amount of force required to cause shuttle 18 to travel inside housing 16 of the chair mechanism 10.

Figure 18C:
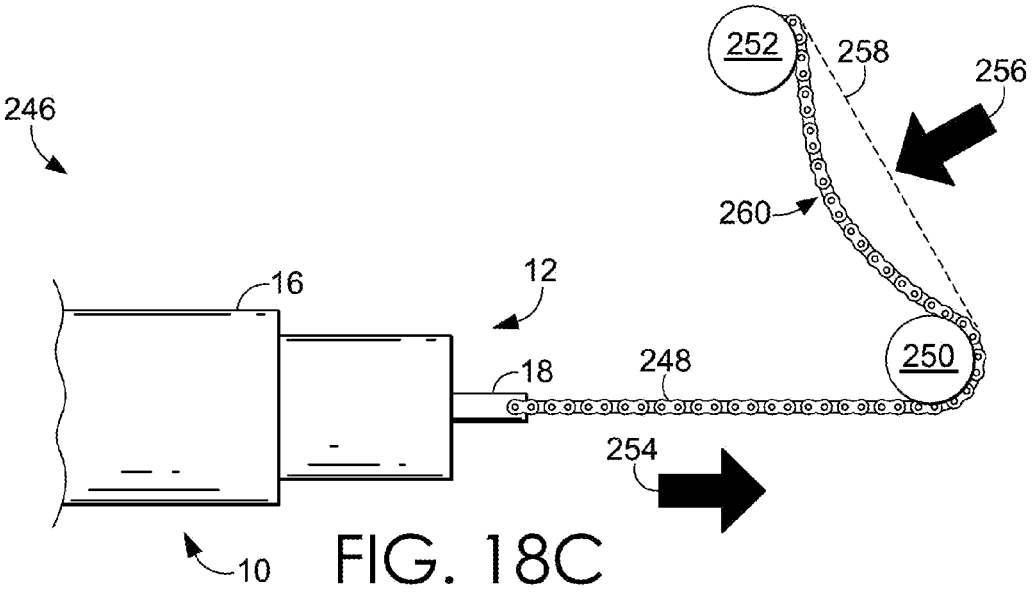

FIG. 18C includes a balancing mechanism 246 with link 248 (coupled to shuttle 18), that abuts a perimeter of cam 250 and couples to cam 252. Cams 250 and 252 guide link 248 in a direction of travel 254 away from the first end 12 of chair mechanism 10. Further, as force is applied in the direction of travel 256, a portion of link 248 moves from a first position 258 to a second position 260 in the direction of travel 256. Accordingly, an amount of force is applied against biasing member 20 based on the force applied to link 248, and the corresponding travel of a portion of link 248 from a first position 258 to a second position 260.

From the foregoing, it will be seen that this invention is one well adapted to attain all the ends and objects hereinabove set forth together with other advantages, which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A modular chair mechanism for use on a chair having a seat support assembly and a back support assembly, the modular chair mechanism comprising:

a housing positioned along a central longitudinal axis, the housing having first and second ends along the central longitudinal axis, at least a portion of the housing having a rounded exterior surface and having at least one opening on the rounded exterior surface of the housing;

a shuttle adapted to travel relative to the housing along the central longitudinal axis, the shuttle having first and second ends, at least a portion of the first end of the shuttle exiting the first end of the housing, at least a portion of the second end of the shuttle having at least one retaining feature adapted to selectively abut the at least one opening, wherein travel of the shuttle relative to the housing limits travel of the back support assembly;

at least one biasing member for resisting the travel of the shuttle relative to the housing; and a self-weighing assembly coupled to the biasing member, the self-weighing assembly adapted to apply an initial amount of force against the biasing member, wherein the modular chair mechanism is configured to couple to an interface, wherein upon coupling the interface to the first end of the shuttle, the interface is adapted to selectively adjust a rate of compression of the biasing member during travel of the shuttle inside the housing, wherein the at least one opening on the rounded exterior surface of the housing comprises a plurality of retaining means at staggered positions relative to the central longitudinal axis, wherein the at least one retaining feature is adapted to selectively abut one or more of the plurality of retaining means based on travel of the shuttle relative to the housing.

2. The modular chair mechanism of claim 1, wherein the at least one retaining feature is aligned along the central longitudinal axis to selectively abut one of the plurality of retaining means based on rotation of the shuttle relative to the housing.

3. The modular chair mechanism of claim 1, wherein the at least one opening further comprises a forward-locking opening on the rounded exterior surface of the housing, wherein the at least one retaining feature is adapted to selectively abut the forward locking opening to prevent travel of the shuttle relative to the housing along the central longitudinal axis.

4. The modular chair mechanism of claim 1, further comprising a collar that travels on an outside of the housing, the collar having a plurality of retaining means at staggered positions relative to the central longitudinal axis, wherein the at least one retaining feature is adapted to selectively abut one or more of the plurality of retaining means based on travel of the shuttle relative to the housing.

5. The modular chair mechanism of claim 4, wherein the at least one retaining feature is aligned along the central longitudinal axis to selectively abut one of the plurality of retaining means based on rotation of the collar on the outside of the housing.

6. The modular chair mechanism of claim 1, wherein the interface configured to couple to the first end of the shuttle comprises:

a link;

an adjustable mounting point coupled to the link; and a pivoting body coupled to a portion of the seat support assembly, wherein the adjustable mounting point is adapted to slidably engage with a portion of the pivoting body, and further wherein slidably engaging the adjustable mounting body with a portion of the pivoting body alters a rate of compression of the biasing member.

7. The modular chair mechanism of claim 1, wherein the interface configured to couple to the first end of the shuttle comprises:

a link; and a translating cam adapted to translate toward or away from the housing, wherein translating the cam toward or away from the housing adjusts an amount of extension of the link, wherein adjusting the amount of extension of the link alters a rate of compression of the biasing member.

8. The modular chair mechanism of claim 1, wherein the interface configured to couple to the first end of the shuttle comprises:

a link;

a first cam having a profile that engages the link; and a second cam engaged against to the first cam, wherein rotation of the second cam alters the profile of the first cam with respect to engagement of the link, and further wherein rotation of the second cam changes a rate of compression of the biasing member.

9. The modular chair mechanism of claim 1, wherein the interface configured to couple to the first end of the shuttle comprises:

a link;

a cam having a plurality of profiles along an axis of rotation; and a cam follower having a link guide, the cam follower adapted to translate along the axis of rotation of the cam, wherein translating along the axis of rotation engages the link guide against one of the plurality of profiles, and further wherein translating the cam follower changes a rate of compression of the biasing member.

10. The modular chair mechanism of claim 1, wherein the interface configured to couple to the first end of the shuttle comprises:

a link;

a stationary feature coupled to the seat support assembly; and an adjustable feature coupled to the stationary feature, the adjustable feature having an arcuate profile, wherein the adjustable feature is adapted to guide the link traveling along a path of the adjustable feature, and further wherein changing a position of the adjustable feature changes the path of the adjustable feature such that a rate of compression of the biasing member is altered.

11. The modular chair mechanism of claim 1, wherein the self-weighing assembly comprises one or more of the following:

a rotating cam adjacent a stationary cam coupled to the biasing member, wherein rotation of the rotating cam applies tension axially on the biasing member along the central longitudinal axis;

a link coupled to the biasing member, the link positioned along a diagonal axis relative to the central longitudinal axis, wherein tension is applied to the biasing member based on the link traveling along the diagonal axis and engaging against the biasing member;

a cam coupled to a link, wherein compression of the link causes the cam to pivot such that the cam applies tension to the biasing member; and a first link coupled to a second link, wherein the first link is fixed and the second link is adapted to travel based on movement of the seat support assembly, wherein travel of the second link reduces the distance between at least a portion of the first and second links and applies tension to the biasing member.

12. A modular chair mechanism, comprising:

a housing having a central longitudinal axis, the housing having first and second ends along the central longitudinal axis, at least a portion of the housing having a rounded exterior surface and at least one opening on the rounded exterior surface, wherein the opening comprises a plurality of retaining means at staggered positions relative to the central longitudinal axis;

a shuttle adapted to travel relative to the housing along the central longitudinal axis, the shuttle having first and second ends, at least a portion of the first end of the shuttle exiting the first end of the housing, wherein at least one retaining feature coupled to the second end of the shuttle is adapted to selectively abut one or more of the plurality of retaining means on the rounded exterior surface of the housing based on travel of the shuttle relative to the housing;

at least one biasing member for resisting the travel of the shuttle relative to the housing; and a self-weighing assembly coupled to the shuttle, the self-weighing assembly adapted to apply an initial amount of force against the biasing member, wherein the modular chair mechanism is configured to couple to an interface, wherein upon coupling the interface to the first end of the shuttle, the interface is adapted to selectively adjust an amount of force required to cause the shuttle to travel relative to the housing along the central longitudinal axis.

13. The modular chair mechanism of claim 12, wherein the interface comprises:

a link;

an adjustable mounting point coupled to the link;

a pivoting body that rotates relative to an axis of rotation, the pivoting body having an exterior surface with a first opening, wherein the adjustable mounting point is adapted to slidably engage with the first opening of the pivoting body, and further wherein slidably engaging the adjustable mounting body with the first opening alters a rate of compression of the biasing member; and a locking pin adapted to be coupled to a second opening on the exterior surface of the pivoting body, wherein coupling the locking pin to the second opening comprises preventing rotation of the pivoting body.

14. The modular chair mechanism of claim 12, wherein the interface comprises:

a link; and a translating feature adapted to translate toward or away from the housing, wherein translating the feature toward or away from the housing adjusts an amount of extension of the link, wherein adjusting the amount of extension of the link alters a rate of compression of the biasing member.

15. The modular chair mechanism of claim 12, wherein the interface comprises:

a link;

a first feature having a profile that engages the link; and a second feature engaged against to the first feature, wherein rotation of the second feature alters the profile of the first feature with respect to engagement of the link, and further wherein rotation of the second feature changes a rate of compression of the biasing member.

16. The modular chair mechanism of claim 12, wherein the interface comprises:

a link;

a cam having a plurality of profiles along an axis of rotation; and a cam follower having a link guide, the cam follower adapted to translate along the axis of rotation of the cam, wherein translating along the axis of rotation engages the link guide against one of the plurality of profiles, and further wherein translating the cam follower changes a rate of compression of the biasing member.

17. The modular chair mechanism of claim 12, wherein the interface comprises:

a link;

a stationary feature coupled to the seat support assembly; and an adjustable feature coupled to the stationary feature, the adjustable feature having an arcuate profile, wherein the adjustable feature is adapted to guide the link traveling along a path of the adjustable feature, and further wherein changing a position of the adjustable feature changes the path of the adjustable feature such that a rate of compression of the biasing member is altered.

18. A modular chair mechanism for use on a chair having a seat support assembly and a back support assembly, the modular chair mechanism comprising:

a housing positioned along a central longitudinal axis, the housing having first and second ends along the central longitudinal axis, at least a portion of the housing having at least one opening on a curved surface of the housing;

a shuttle adapted to travel inside the housing along the central longitudinal axis, the shuttle having first and second ends, at least a portion of the first end of the shuttle exiting the first end of housing, wherein at least a portion of the second end of the shuttle is adapted to engage against the at least one opening on the curved surface of the housing, and further wherein travel of the shuttle inside the housing limits travel of the back support assembly;

at least one biasing member for resisting the travel of the shuttle inside the housing;

a self-weighing assembly coupled to the shuttle, the self-weighing assembly adapted to apply an initial amount of force against the biasing member; and an interface coupled to the first end of the shuttle, the interface adapted to selectively adjust a rate of compression of the biasing member during travel of the shuttle inside the housing, wherein at least a portion of the interface is coupled to the back support assembly, wherein the at least one opening on the curved surface of the housing comprises a plurality of retaining means at staggered positions relative to the central longitudinal axis, wherein the at least one retaining feature is adapted to selectively abut one or more of the plurality of retaining means based on travel of the shuttle relative to the housing.

* * * * *